US011086249B2

(12) United States Patent
Naito et al.

(10) Patent No.: US 11,086,249 B2
(45) Date of Patent: Aug. 10, 2021

(54) IMAGE FORMING APPARATUS HAVING FIRST AND SECOND PERIPHERAL VELOCITY RATIOS

(71) Applicant: CANON KABUSHIKI KAISHA, Tokyo (JP)

(72) Inventors: Norihito Naito, Numazu (JP); Go Shindo, Mishima (JP); Masataka Mochizuki, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/799,924

(22) Filed: Feb. 25, 2020

(65) Prior Publication Data

US 2020/0192237 A1 Jun. 18, 2020

Related U.S. Application Data

(63) Continuation of application No. 15/461,935, filed on Mar. 17, 2017, now Pat. No. 10,599,063.

(30) Foreign Application Priority Data

Mar. 22, 2016 (JP) ..... 2016-057626

(51) Int. Cl.
*G03G 15/06* (2006.01)
*G03G 15/00* (2006.01)
(Continued)

(52) U.S. Cl.
CPC ..... *G03G 15/065* (2013.01); *G03G 15/0266* (2013.01); *G03G 15/0815* (2013.01);
(Continued)

(58) Field of Classification Search
CPC ..... G03G 15/5008
See application file for complete search history.

(56) References Cited

U.S. PATENT DOCUMENTS 5,095,341 A * 3/1992 Yoshida ..... G03G 15/0806 399/284
6,801,724 B2 10/2004 Matsumoto et al.
(Continued)

FOREIGN PATENT DOCUMENTS

EP 2 267 556 A2 12/2010
EP 2 645 173 A1 10/2013
(Continued)

OTHER PUBLICATIONS

European Search Report dated Jul. 20, 2017, in related European Patent Application No. 17161986.9.

*Primary Examiner* — Arlene Heredia
(74) *Attorney, Agent, or Firm* — Venable LLP

(57) ABSTRACT

An image forming apparatus includes a motor configured to rotationally drive an image bearing roller and a developer bearing roller at a first peripheral velocity ratio and a second peripheral velocity ratio which is larger than the first peripheral velocity ratio. A development contrast formed between a developing bias to the developer bearing roller and a light-part potential formed on the image bearing roller in a case where a development operation is performed at the second peripheral velocity ratio is larger than a development contrast formed between the developing bias to the developer bearing roller and the light-part potential formed on the image bearing roller in a case where the development operation is performed at the first peripheral velocity ratio.

12 Claims, 12 Drawing Sheets

(51) Int. Cl.
*G03G 15/08* (2006.01)
*G03G 15/02* (2006.01)

(52) U.S. Cl.
CPC ..... *G03G 15/0856* (2013.01); *G03G 15/0898* (2013.01); *G03G 15/5008* (2013.01); *G03G 15/5037* (2013.01)

(56) References Cited

U.S. PATENT DOCUMENTS

| | | | | |
|---|---|---|---|---|
| 7,003,249 | B2 | 2/2006 | Hasegawa et al. | |
| 7,151,901 | B2 | 12/2006 | Hirai | |
| 7,317,889 | B2 | 1/2008 | Suzuki | |
| 8,824,906 | B2 | 9/2014 | Ishihara et al. | |
| 9,411,259 | B2 | 8/2016 | Hayashi et al. | |
| 10,036,977 | B2 * | 7/2018 | Ono | G03G 15/065 |
| 2001/0031157 | A1 | 10/2001 | Yoshii et al. | |
| 2005/0191073 | A1 * | 9/2005 | Kawamura | G03G 15/0806 399/55 |
| 2006/0127133 | A1 | 6/2006 | Suzuki | |
| 2008/0292343 | A1 | 11/2008 | Gomi et al. | |
| 2008/0310868 | A1 | 12/2008 | Shin | |
| 2009/0225342 | A1 | 9/2009 | Ogasawara | |
| 2017/0031314 | A1 * | 2/2017 | Suzuki | G03G 21/203 |
| 2019/0137923 | A1 * | 5/2019 | Hirata | G03G 15/556 |

FOREIGN PATENT DOCUMENTS

| | | | |
|---|---|---|---|
| JP | S54-106240 | U | 7/1979 |
| JP | H05-27580 | A | 2/1993 |
| JP | H08-194368 | A | 7/1996 |
| JP | H08-227222 | A | 9/1996 |
| JP | H08-265570 | A | 10/1996 |
| JP | H08-297384 | A | 11/1996 |
| JP | H09-43931 | A | 2/1997 |
| JP | 2003-270876 | A | 9/2003 |
| JP | 2004-170660 | A | 6/2004 |
| JP | 2006-171245 | A | 6/2006 |
| JP | 2013-190722 | A | 9/2013 |
| JP | 2013-210489 | A | 10/2013 |
| JP | 2015-175999 | A | 10/2015 |

* cited by examiner

IMAGE FORMING APPARATUS HAVING FIRST AND SECOND PERIPHERAL VELOCITY RATIOS

This application is a continuation of Application Ser. No. 15/461,935, filed Mar. 17, 2017.

BACKGROUND OF THE INVENTION

Field of the Invention

The present invention relates to an image forming apparatus using an electrophotographic system.

Description of the Related Art

Conventionally, as an image forming apparatus such as a laser beam printer, an image forming apparatus is known which adopts an in-line color system and which is constituted by a plurality of image forming stations in which a photosensitive drum as an image bearing member is arranged in plurality in a rotation direction of an intermediate transfer member. In the image forming apparatus, an electrostatic latent image created on the photosensitive drum in each of the plurality of image forming stations is developed into a toner image by developing means, and the resultant is primarily transferred to the intermediate transfer member. By similarly repeating primary transfers in the plurality of image forming stations in this step, a full-color toner image is formed on the intermediate transfer member. Subsequently, the full-color toner image is secondarily transferred to recording material and, furthermore, the full-color toner image is fixed to the recording material by fixing means. An image formed by the series of image forming operations must represent output of an image and density intended by a user. In addition, a full-color image created by the plurality of image forming stations requires tinge reproducibility and stability.

In consideration thereof, Japanese Patent Application Laid-open No. H8-227222 proposes a method of increasing a tinge selection range by changing a developing bias or a rotational speed of a developing roller as a developer bearing member or the like according to purpose. In addition, Japanese Patent Application Laid-open No. 2013-210489 proposes a method for overcoming problems such as toner scattering and image thinning which accompany an increase in a tinge selection range or an improvement in density. This method enables an image with an increased tinge selection range or a high-density image to be output without causing image-related problems by reducing a peripheral velocity of a photosensitive drum to increase a peripheral velocity ratio between the photosensitive drum and a developing roller. Furthermore, in a case of high-density printing such as solid black, by forming a development contrast such that all of toner on a developing roller is developed onto a photosensitive drum, a tinge selection range is increased, high density is realized, and stabilization is provided while minimizing an effect of a potential fluctuation of the photosensitive drum and the like.

SUMMARY OF THE INVENTION

As described above, Japanese Patent Application Laid-open No. H8-227222 and Japanese Patent Application Laid-open No. 2013-210489 enable a tinge selection range to be increased and high-density printing to be performed by increasing a toner supply amount from a developing roller to a photosensitive drum. However, when an increase in a tinge selection range and high-density output as described in Japanese Patent Application Laid-open No. H8-227222 and Japanese Patent Application Laid-open No. 2013-210489 are consecutively performed in addition to normal printing operations, consumption of toner of the developing roller is accelerated as the toner is developed onto the photosensitive drum and a toner supply amount to the developing roller itself may run short. It is found that a shortage of the toner supply amount to the developing roller may result in an image containing image density non-uniformity and tinge variations and may prevent an intended image from being obtained.

An object of the present invention is to provide a technique for reducing effects of image density non-uniformity, color non-uniformity, and the like on an output image.

In order to achieve the object described above, an image forming apparatus according to an embodiment of the present invention is an image forming apparatus, comprising:

an image bearing member;

a developer bearing member configured to perform a development operation in which an electrostatic image formed on the image bearing member is developed with a developer;

driving means configured to rotationally drive the image bearing member and the developer bearing member, respectively so that the peripheral velocities of each is variable individually;

latent image forming means configured to form an electrostatic image on the image bearing member by forming a light-part potential and a dark-part potential on the image bearing member; and applying means configured to apply a developing bias to the developer bearing member, wherein when a peripheral velocity ratio is defined as a ratio of the peripheral velocity of the developer bearing member to the peripheral velocity of the image bearing member, the driving means is configured to be capable of driving the image bearing member and the developer bearing member at a first peripheral velocity ratio and a second peripheral velocity ratio which is larger than the first peripheral velocity ratio, and when C denotes capacitance between the image bearing member and the developer bearing member in a state that the developer is sandwiched between the image bearing member and the developer bearing member while the developer is supplied to the image bearing member from the developer bearing member, $\Delta V$ denotes a development contrast which is a potential difference between the light-part potential and the developing bias, Q/S denotes a charge amount per unit area of the developer borne by the developer bearing member, and $\Delta v$ denotes the peripheral velocity ratio, the first peripheral velocity ratio is set so that a relationship expressed by $|Q/S \times \Delta v| \leq |C \times \Delta V|$ is satisfied, and the second peripheral velocity ratio is set so that a relationship expressed by $|Q/S \times \Delta v| > |C \times \Delta V|$ is satisfied.

In order to achieve the object described above, an image forming apparatus according to an embodiment of the present invention is an image forming apparatus, comprising:

an image bearing member;

a developer bearing member configured to perform a development operation in which an electrostatic image formed on the image bearing member is developed with a developer; and driving means configured to rotationally drive the image bearing member and the developer bearing member respectively so that the peripheral velocities of each is variable individually, wherein when a peripheral velocity ratio is defined as a ratio of the peripheral velocity of the developer bearing member to the peripheral velocity of the image bearing member, the driving means is configured to be capable of driving the image bearing member and the developer bearing member at a first peripheral velocity ratio and a second peripheral velocity ratio which is larger than the first peripheral velocity ratio, and wherein the first peripheral velocity ratio and the second peripheral velocity ratio are set so that an amount of the developer remaining on the developer bearing member after the development operation in a case where the development operation is performed at the second peripheral velocity ratio is larger than that in a case where the development operation is performed at the first peripheral velocity ratio.

According to the present invention, effects of image density non-uniformity, color non-uniformity, and the like on an output image can be reduced.

Further features of the present invention will become apparent from the following description of exemplary embodiments with reference to the attached drawings.

DESCRIPTION OF THE EMBODIMENTS

Modes for carrying out the present invention are illustratively explained in detail below on the basis of embodiments with reference to the drawings. However, dimensions, materials, and shapes of components described in the embodiments, relative arrangement of the components, and the like should be changed as appropriate according to the configuration of an apparatus to which the invention is applied and various conditions. That is, the dimensions, the materials, the shapes, and the relative arrangement are not intended to limit the scope of the present invention to the embodiments.

First Embodiment

An image forming apparatus according to the present embodiment has two image formation modes: an image formation mode A for obtaining normal image density; and an image formation mode B for obtaining high density or increasing a tinge selection range by changing a peripheral velocity ratio between a photosensitive drum as an image bearing member and a developing roller as a developer bearing member. Each image formation mode has a different ratio of rotational speed (a peripheral velocity ratio) between a photosensitive drum and a developing roller particularly under a condition of forming a solid black image. In the image formation mode A, with respect to a development contrast formed by an electrostatic latent image formed on the photosensitive drum and a developing bias applied to the developing roller, all of the toner on the developing roller is developed onto the photosensitive drum. In the image formation mode B, the peripheral velocity ratio between the photosensitive drum and the developing roller is increased to increase a toner supply amount from the developing roller to the photosensitive drum. In addition, by reducing or canceling an electrical gradient created by the development contrast by a charge of the toner having been imparted a charge on the developing roller, a part of the toner on the developing roller is retained on the developing roller instead of being transferred to the photosensitive drum.

[Image Forming Apparatus]

Figure 2:
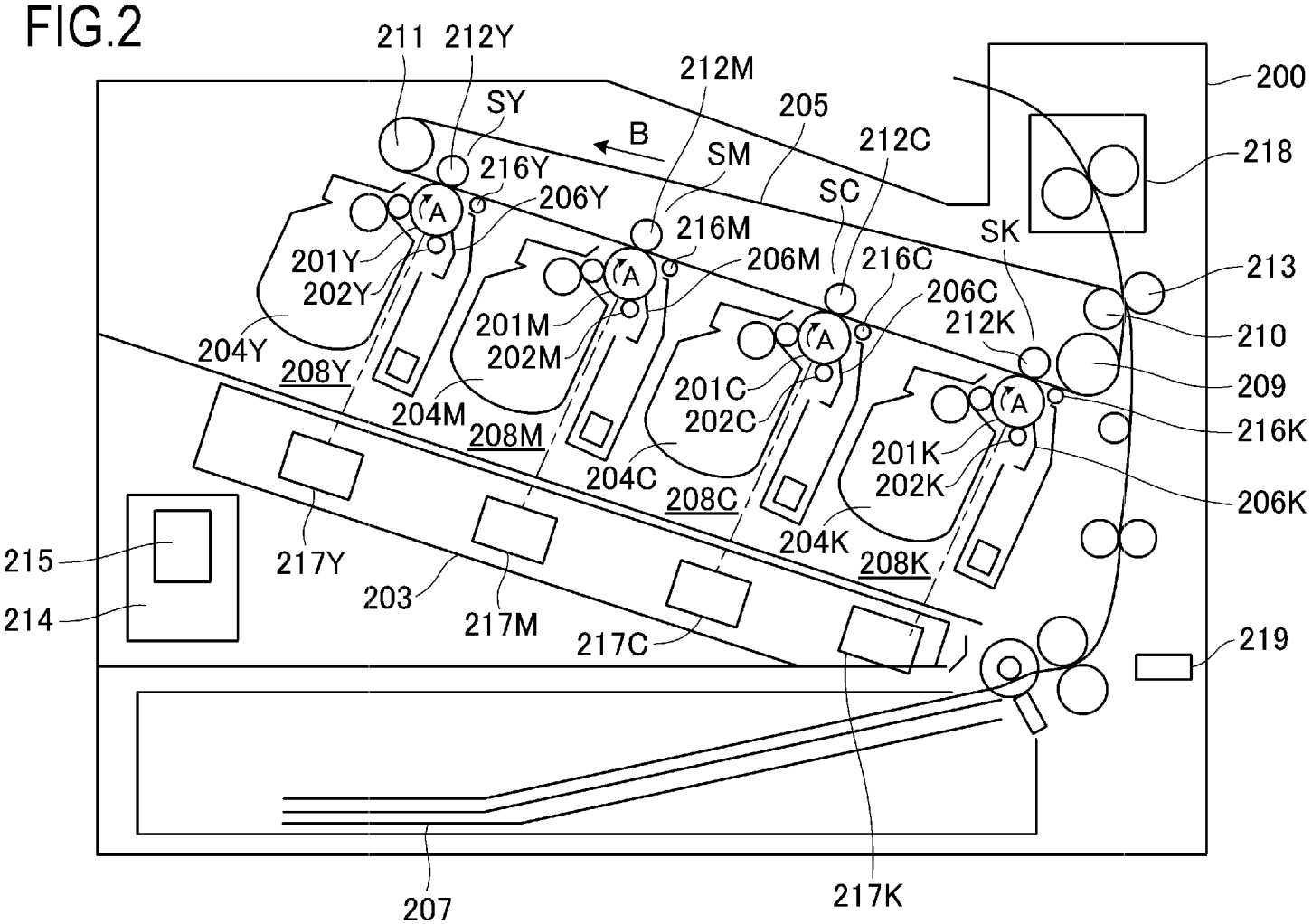
FIG. 2 is a schematic view of an image forming apparatus according to first and second embodiments of the present invention.

An image forming apparatus according to an embodiment of the present invention will now be described with reference to FIG. 2 using an electrophotographic system as an example. FIG. 2 is a schematic sectional view of an image forming apparatus 200 according to the present embodiment. The image forming apparatus 200 according to the present embodiment is a full-color laser printer adopting an in-line system and an intermediate transfer system. The image forming apparatus 200 is configured to be capable of forming a full-color image on recording material (for example, recording paper, a plastic sheet, and cloth) in accordance with image information. The image information is input to a CPU 215 provided in an engine controller 214 from an image reading apparatus connected to the image forming apparatus 200 or from a host device (not shown) such as a personal computer which is connected to the image forming apparatus 200 so as to be capable of communication.

As a plurality of image forming portions, the image forming apparatus 200 includes first, second, third, and fourth image forming stations SY, SM, SC, and SK for respectively forming images of the colors yellow (Y), magenta (M), cyan (C), and black (K). In this case, an image forming station is constituted by a process cartridge 208 and a primary transfer roller 212 arranged on an opposite side via an intermediate transfer belt 205. In the present embodiment, the first to fourth image forming portions SY, SM, SC, and SK are arranged in a single row in a direction intersecting a vertical direction. Moreover, in the present embodiment, configurations and operations of the first to fourth image forming portions are substantially the same with the exception of differences in colors of formed images. Therefore, unless the image forming portions must be distinguished from one another, the suffixes Y, M, C, and K added to the reference characters to represent which color is to be produced by which element will be omitted and the image forming portions will be collectively described. Alternatively, a configuration may be adopted in which a process cartridge for black which is used more frequently has a larger size than other process cartridges.

The process cartridge 208 is configured to be attachable and detachable to and from an image forming apparatus main body (hereinafter, an apparatus main body) via mounting means such as a mounting guide or a positioning member provided on the apparatus main body. In this case, the apparatus main body refers to an apparatus constituent portion of the configuration of the image forming apparatus 200 from at least the process cartridge 208 is excluded. Alternatively, a configuration in which a developing unit 204 (to be described later) is independently attachable and detachable to and from an apparatus main body may be adopted, in which case an apparatus constituent portion of the configuration of the image forming apparatus 200 excluding the developing unit 204 may be considered the apparatus main body.

As a plurality of image bearing members, the image forming apparatus 200 includes four drum-shaped electrophotographic photoreceptors or, in other words, four photosensitive drums 201 arranged parallel to each other in a direction intersecting the vertical direction. The photosensitive drum 201 is rotationally driven in a direction of an illustrated arrow A (clockwise) by a motor drive portion 404 shown in FIG. 3 as driving means (a drive source). A charging roller 202 is charging means configured to uniformly charge a surface of the photosensitive drum 201. A scanner unit (an exposing apparatus) 203 is exposing means configured to irradiate a laser based on image information to form an electrostatic image (an electrostatic latent image) on the photosensitive drum 201, and includes lasers 217 in a number corresponding to the number of the photosensitive drums 201. The developing unit (a developing apparatus) 204 is developing means configured to develop an electrostatic image as a toner image. A cleaning blade 206 is cleaning means configured to remove toner (untransferred toner) remaining on a surface of the photosensitive drum 201 after transfer, and a preliminary exposure LED 216 eliminates a potential on the photosensitive drum 201. The intermediate transfer belt 205 is arranged so as to oppose the four photosensitive drums 201 and functions as an intermediate transfer member for transferring a toner image on the photosensitive drum 201 to a recording material 207. The process cartridge 208 is integrally constituted by the photosensitive drum 201, the charging roller 202 as charging process means of the photosensitive drum 201, the developing unit 204, and the cleaning blade 206 and is configured so as to be attachable and detachable to and from the image forming apparatus 200. In the present embodiment, all of the process cartridges 208 for the respective colors have a same shape, and toners of the respective colors of yellow (Y), magenta (M), cyan (C), and black (K) are housed in the respective process cartridges 208. In addition, the toners used in the present embodiment are toners having negative-charging characteristics (of which a normal charging polarity is negative).

The intermediate transfer belt 205 as an intermediate transfer member formed by an endless belt is in contact with all photosensitive drums 201 as image bearing members and rotates in a direction of an illustrated arrow B (counterclockwise). The intermediate transfer belt 205 is stretched over a plurality of supporting members including a driver roller 209, a secondary transfer opposing roller 210, and a driven roller 211. Four primary transfer rollers 212 as primary transfer means are arranged parallel to each other on a side of an inner peripheral surface of the intermediate transfer belt 205 so as to oppose each photosensitive drum 201. In addition, a bias having an opposite polarity to the normal charging polarity (in the present embodiment, negative polarity as described earlier) of the toners is applied to the primary transfer rollers 212 from a primary transfer bias power supply (not shown). Accordingly, a toner image on the photosensitive drum 201 is transferred onto the intermediate transfer belt 205. In addition, a secondary transfer roller 213 as secondary transfer means is arranged at a position opposing the secondary transfer opposing roller 210 on a side of an outer peripheral surface of the intermediate transfer belt 205. Furthermore, a bias having an opposite polarity to the normal charging polarity of the toners is applied to the secondary transfer roller 213 from a secondary transfer bias power supply (not shown). Accordingly, a toner image on the intermediate transfer belt 205 is transferred onto the recording material 207.

The recording material 207 onto which the toner image has been transferred is conveyed to a fixing apparatus 218 as fixing means. Heat and pressure are applied to the recording material 207 by the fixing apparatus 218 to fix the toner image onto the recording material 207. Subsequently, the recording material 207 onto which the toner image has been fixed is discharged to a paper discharge tray provided on an upper surface of the apparatus main body.

[Process Cartridge]

Figure 3:
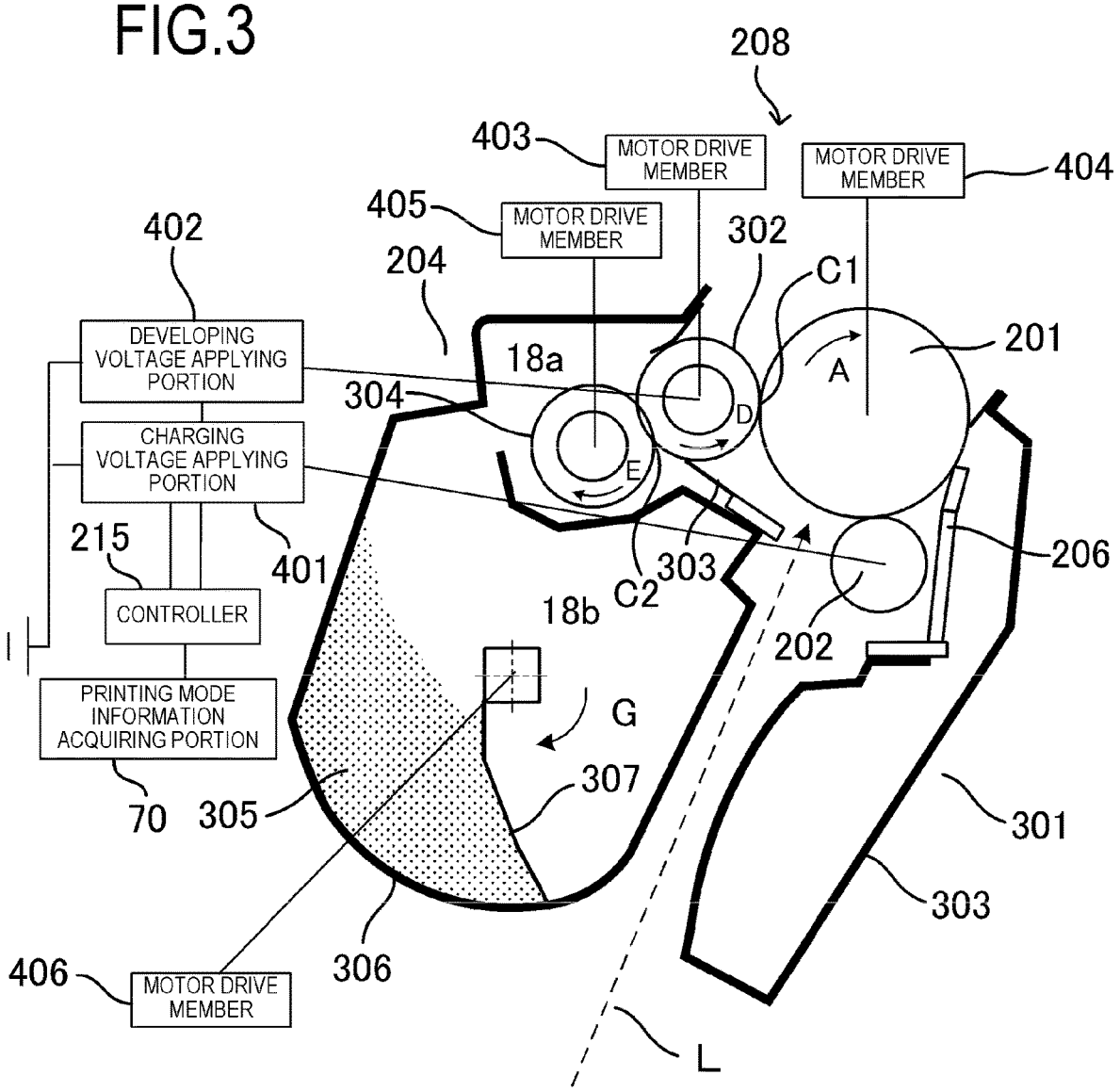
FIG. 3 is a schematic view of a process cartridge according to an embodiment of the present invention.

The process cartridge 208 to be mounted to the image forming apparatus 200 according to the present embodiment will now be described with reference to FIG. 3. FIG. 3 is a sectional (main sectional) view schematically showing a cross section perpendicular to a longitudinal direction (a rotational axis direction) of the photosensitive drum 201 as an image bearing member. In the present embodiment, configurations and operations of the process cartridges 208 of the respective colors are substantially the same with the exception of types (colors) of developers housed therein.

The process cartridge 208 includes a photoreceptor unit 301 including the photosensitive drum 201 as an image bearing member and the like and the developing unit 204 including a developing roller 302 and the like. The photoreceptor unit 301 includes a cleaning frame body 303 as a frame body that supports various elements in the photoreceptor unit 301. The photosensitive drum 201 is rotatably attached to the cleaning frame body 303 via a bearing member (not shown). The photosensitive drum 201 is rotationally driven in the direction of the illustrated arrow A (clockwise) in accordance with an image forming operation as a driving force of the motor drive portion 404 as driving means (a drive source) is transferred to the photoreceptor unit 301. As the photosensitive drum 201 which is to perform a central role of an image forming process, an organic photoreceptor is used in which an outer circumferential surface of an aluminum cylinder is sequentially coated with an undercoat layer, a carrier generation layer, and a carrier transfer layer which are functional membranes. In addition, the cleaning blade 206 and the charging roller 202 are arranged in the photoreceptor unit 301 so as to come into contact with a circumferential surface of the photosensitive drum 201. Untransferred toner removed from the surface of the photosensitive drum 201 by the cleaning blade 206 is dropped into and housed in the cleaning frame body 303.

The charging roller 202 which is charging means is driven to rotate when a roller portion made of conductive rubber is brought into pressure contact with the photosensitive drum 201 as an image bearing member. In a core of the charging roller 202, as a charging step, prescribed DC voltage as a charging bias is applied to the photosensitive drum 201 from a charging voltage applying portion (high-voltage power supply) 401 as charging roller bias applying means. Accordingly, a uniform dark-part potential (Vd) is formed on the surface of the photosensitive drum 201. The scanner unit 203 described earlier emits laser light L corresponding to image data to expose the photosensitive drum 201. In the exposed photosensitive drum 201, charges on the surface are eliminated by a carrier from the carrier generation layer and the potential drops. As a result, an electrostatic latent image in which an exposed portion has a prescribed light-part potential (Vl) and an unexposed portion has a prescribed dark-part potential (Vd) is formed on the photosensitive drum 201. In the electrostatic latent image, a zone in which the light-part potential is formed is a zone to which toner is to be adhered and a zone in which the dark-part potential is formed is a zone to which toner is not to be adhered.

The developing unit 204 includes a container frame body 306 having a developing chamber 18*a* and a developer housing chamber 18*b*. The developer housing chamber 18*b* is arranged below the developing chamber 18*a* and communicates with the developing chamber 18*a* via a communication port provided in an upper part of the developer housing chamber 18*b*. Toner 305 as a developer is housed inside the developer housing chamber 18*b*. In addition, the developer housing chamber 18*b* is provided with a stirring member (developer conveying member) 307 for conveying the toner 305 to the developing chamber 18*a*. The stirring member 307 conveys the toner 305 to the developing chamber 18*a* by rotating in a direction of an illustrated arrow G. The stirring member 307 rotates by obtaining a rotational driving force from a motor drive portion 406 as driving means. Moreover, in the present embodiment, toner of which a normal charging polarity is negative is used as the toner 305 as described above. Accordingly, the following description assumes the use of a negative-charging toner. However, toners usable in the present invention are not limited to a negative-charging toner and, depending on apparatus configuration, toner of which a normal charging polarity is positive may be used.

The developing chamber 18*a* is provided with the developing roller 302 as a developer bearing member which comes into contact with the photosensitive drum 201 as an image bearing member and which rotates in a direction of an illustrated arrow D by receiving a driving force from a motor drive portion 403 as driving means. In the present embodiment, the developing roller 302 and the photosensitive drum 201 respectively rotate so that respective surfaces thereof move in a same direction in an opposing portion (a contact portion C1) which is a portion where the toner 305 borne by the developing roller 302 is supplied to the photosensitive drum 201. In addition, a prescribed DC bias (developing bias) sufficient to develop and visualize an electrostatic latent image on the photosensitive drum 201 as a toner image (developer image) is applied to the developing roller 302 from a developing voltage applying portion (high-voltage power supply) 402 as developing bias applying means. The electrostatic latent image is visualized in the contact portion C1 where the developing roller 302 and the photosensitive drum 201 are in contact with each other by transferring toner only to portions with the light-part potential using a potential difference between the developing roller 302 and the photosensitive drum 201.

A toner supplying roller (hereinafter, a supplying roller) 304 and a developing blade (hereinafter, a restricting member) 303 which is a toner amount restricting member are further arranged in the developing chamber 18*a*. The supplying roller 304 as a developer supplying member is a roller for supplying the toner 305 conveyed from the developer housing chamber 18*b* to the developing roller 302. The restricting member 303 restricts a coating amount of, and imparts charges to, the toner on the developing roller 302 supplied by the supplying roller 304. A bias (supplying bias) is applied to the supplying roller 304 from a high-voltage power supply (not shown) as supplying bias applying means.

In this case, the biases applied by the developing voltage applying portion (high-voltage power supply) 402, the charging voltage applying portion (high-voltage power supply) 401, and the supplying roller bias power supply are controlled by the CPU 215 which is a controller based on information obtained by a printing mode information acquiring portion 70. The printing mode information acquiring portion 70 acquires information input using an operating panel (not shown) of the image forming apparatus 200, information input from a printer driver, and the like.

The supplying roller 304 is an elastic sponge roller in which a foam layer is formed on an outer periphery of a conductive core and is arranged so as to form a prescribed contact portion C2 on a circumferential surface of the developing roller 302 in an opposing portion with the developing roller 302. In addition, by receiving a driving force from a motor drive portion 405 as driving means, the supplying roller 304 rotates in a direction of an illustrated arrow E. Moreover, in the present embodiment, the motor drive portions 404, 403, 405, and 406 which drive the photosensitive drum 201, the developing roller 302, the supplying roller 304, and the stirring member 307 are respectively constituted by a motor, a gear train which transmits a rotational driving force of the motor, and the like. The motor drive portions 404, 403, 405, and 406 correspond to driving means capable of rotationally driving, in individual and variable fashion, an image bearing member, a developer bearing member, a supplying member, and a conveying member according to the present embodiment and are controlled by the CPU 215. Furthermore, the drive configuration shown in FIG. 3 applies to process cartridges of yellow (Y), magenta (M), and cyan (C). In other words, a configuration is adopted where driving means configured to rotationally drive a photosensitive drum, driving means configured to rotationally drive a developing roller, driving means configured to rotationally drive a supplying roller, and driving means configured to rotationally drive a stirring member respectively have different driving sources (driving motors). In a process cartridge 208K of black (K), driving means configured to rotationally drive a photosensitive drum, driving means configured to rotationally drive a developing roller, driving means configured to rotationally drive a supplying roller, and driving means configured to rotationally drive a stirring member are constituted by a single shared driving motor.

Figure 4:
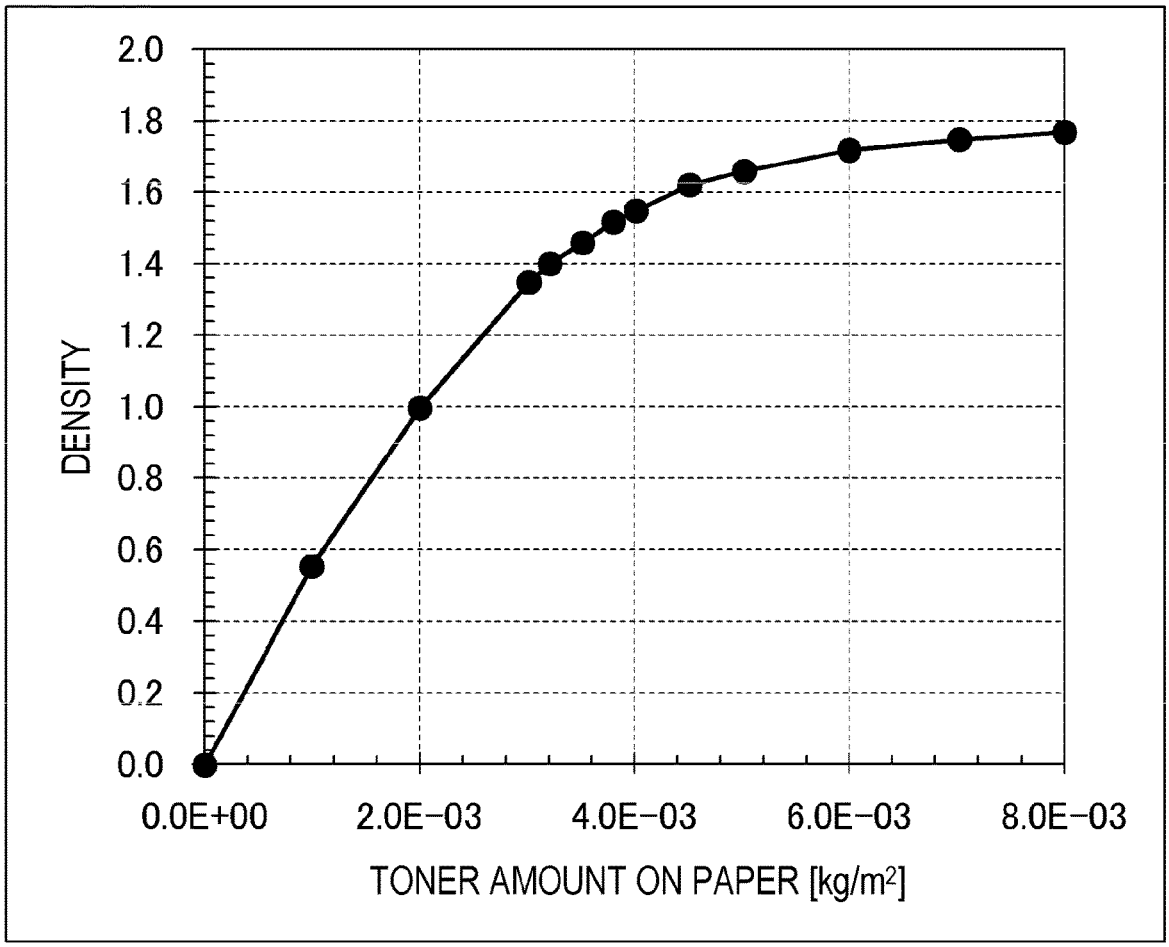
FIG. 4 is an explanatory diagram of an amount of toner on paper and density according to an embodiment of the present invention.

FIG. 4 is a characteristic diagram showing a relationship between a supply amount [kg/m$^2$] of the toner 305 from the developing roller 302 as a developer bearing member to the photosensitive drum 201 as an image bearing member and image formation density, in which a horizontal axis represents a toner amount on paper (on recording material) and a vertical axis represents the density after fixing. In the configuration described above, performing image formation may cause a developed toner amount to fluctuate due to variations in potential among various biases and the like. Image defects such as image density non-uniformity and tinge non-uniformity may occur in an image formed when the toner amount fluctuates. FIG. 4 represents an example thereof. Moreover, the characteristic diagram shown in FIG. 4 is obtained using a reflection densitometer (Macbeth RD-918) manufactured by X-Rite GmbH (previously GretagMacbeth GmbH) as a reflection densitometer. As determination criteria of the image density, for example, an average density of a solid image of 1.3 or higher may be required in an output image of a high-image quality image forming apparatus.

FIG. 4 shows that, when the toner amount ranges from 0 to around 1.2, a change in density after fixing becomes steep and image density non-uniformity may occur due to a variation in the toner amount. An effective method for avoiding image density non-uniformity is to develop the electrostatic image on the photosensitive drum using all of a coat of toner on the developing roller which is formed in a relatively stable manner. To this end, as a development setting when developing a high printing image pattern such as a solid black image, a setting which attains a large absolute value of a potential difference between a light-part potential and a developing bias applied to the developing roller (a large development contrast) is adopted. By forming a latent image having such a sufficient development contrast, even when developing performance varies due to potential fluctuation or the like, a stable toner image-developed image can be obtained. Moreover, a configuration involved with the formation of a development contrast in the present embodiment or, in other words, the charging roller 202, the charging voltage applying portion 401, the scanner unit 203, the developing roller 302, the developing voltage applying portion 402, and the like correspond to latent image forming means according to the present invention.

One of the wide varieties of market needs is to realize higher image density and increased tinge to enable images with enhanced colorfulness to be obtained. To this end, in addition to a mode for obtaining general image density, an operating mode for increasing a toner supply amount to a photosensitive drum by changing a peripheral velocity ratio between the photosensitive drum and a developing roller is proposed as a mode for realizing high density and increased tinge. Examples of a method of increasing the peripheral velocity ratio include increasing a rotational speed of the developing roller and reducing a rotational speed of the photosensitive drum. For example, the peripheral velocity ratio may be changed by reducing both the rotational speed of the developing roller and the rotational speed of the photosensitive drum and, at the same time, differentiating amounts of reduction thereof. In addition, a print image realizing higher density and increased tinge is known to consume a relatively large amount of toner. In many cases, printing conditions for realizing high density and a wide color gamut are set as one of a plurality of selectable modes together with printing conditions for realizing general image quality used in offices and the like, in which case a user can optionally select one of the modes.

It was found that, when a photosensitive drum and a developing roller are operated at a large peripheral velocity ratio in order to obtain a high-density image and high-density images are consecutively output, the supply of toner is sometimes unable to keep up with the consecutive output and image density non-uniformity or tinge non-uniformity may occur. A conceivable cause is as follows. Specifically, when images are consecutively output in a high-density mode which uses toner in large amounts, although the toner itself is supplied to a vicinity of the developing roller, since the supplied toner has fewer opportunities to be imparted with charges, an electrified charge of the toner is weak. Therefore, the supply of toner including toner adhesion to the developing roller is easily destabilized. When supply becomes unstable, a toner coating amount on the developing roller or an electrified charge amount of the toner also becomes unstable. As a result, image density non-uniformity and tinge non-uniformity occur in an image.

In consideration thereof, in the present embodiment, the following operations are performed in an apparatus configuration including, as operating modes of image formation, a normal mode (an image formation mode A) for office applications and the like and a high-density mode (an image formation mode B) for realizing high density and increased tinge. In the normal mode as a first operating mode, a setting condition is adopted so as to have a development contrast resulting in a residual toner amount immediately after a development operation of almost zero with respect to an electrified charge amount per unit area of the toner supplied from the developing roller under a printing condition with solid black density. In the high-density mode as a second operating mode, while increasing a toner supply amount by increasing the peripheral velocity ratio between the photosensitive drum and the developing roller under the same condition is similar to conventional methods, the high-density mode differs from conventional methods in the way the peripheral velocity ratio is increased. In the present embodiment, the peripheral velocity ratio is increased so that the electrified charge amount of the toner supplied from the developing roller further increases with respect to the development contrast and the toner remains on the developing roller or a residual toner amount on the developing roller further increases immediately after a development operation or, in other words, after the developing roller passes the opposing portion with the photosensitive drum. Accordingly, density and tinge are increased and, at the same time, image density non-uniformity and tinge non-uniformity are suppressed.

First, an electrostatic latent image formed on a photosensitive drum and an electrified charge amount of toner will be confirmed. In the present embodiment, a dark-part potential after charging of −500 V and a light-part potential after laser exposure of −100 V are assumed. In the present embodiment, a value of the light-part potential refers to a value of a measurement performed by a surface potentiometer on a photosensitive drum when forming an image pattern involving developing an entire sheet of paper with toner as in the case of a solid black image. A developing potential (a developing bias) applied to the developing roller is assumed to be −300 V and a development contrast ΔV upon the application of the developing potential is assumed to be 200 V. With respect to the toner formed on the developing roller, in the present embodiment, a toner laid-on level per unit area (hereinafter, referred to as M/S) is set to $3.0\times10^{-3}$ kg/m$^2$ and an electrified charge amount of the toner per unit area (hereinafter, referred to as Q/S) is set to $-0.15\times10^{-3}$ C/m$^2$.

A toner supply amount with respect to a development contrast will be confirmed. The confirmation was performed by setting a peripheral velocity of the photosensitive drum to 0.2 m/s and varying a peripheral velocity of the developing roller to change a peripheral velocity ratio which is a ratio of the peripheral velocity of the developing roller to the peripheral velocity of the photosensitive drum. In this case, with 100% representing uniform velocity, the peripheral velocity ratio signifies that, for example, the developing roller rotates faster than the photosensitive drum at 140%.

Alternatively, a configuration may be adopted in which the peripheral velocity ratio is increased by fixing the peripheral velocity of the developing roller to a constant velocity of 0.2 m/s and reducing the peripheral velocity of the photosensitive drum. In addition, since tinge and density are strongly related to each other, the present embodiment will be described using density. Furthermore, black toner was used as the toner in the present evaluation. Results thereof are shown in FIGS. 1A and 1B.

Figure 1A:
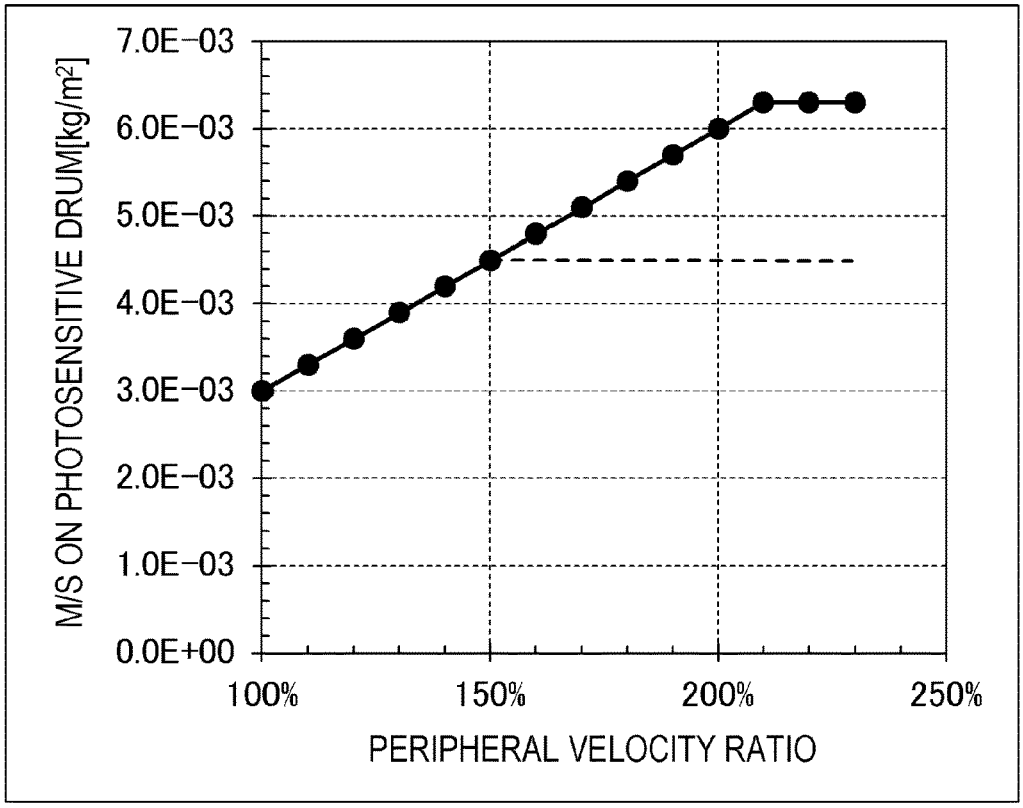
FIGS. 1A and 1B are explanatory diagrams of a peripheral velocity ratio and a state of toner on a photosensitive drum according to an embodiment of the present invention.
Figure 1B:
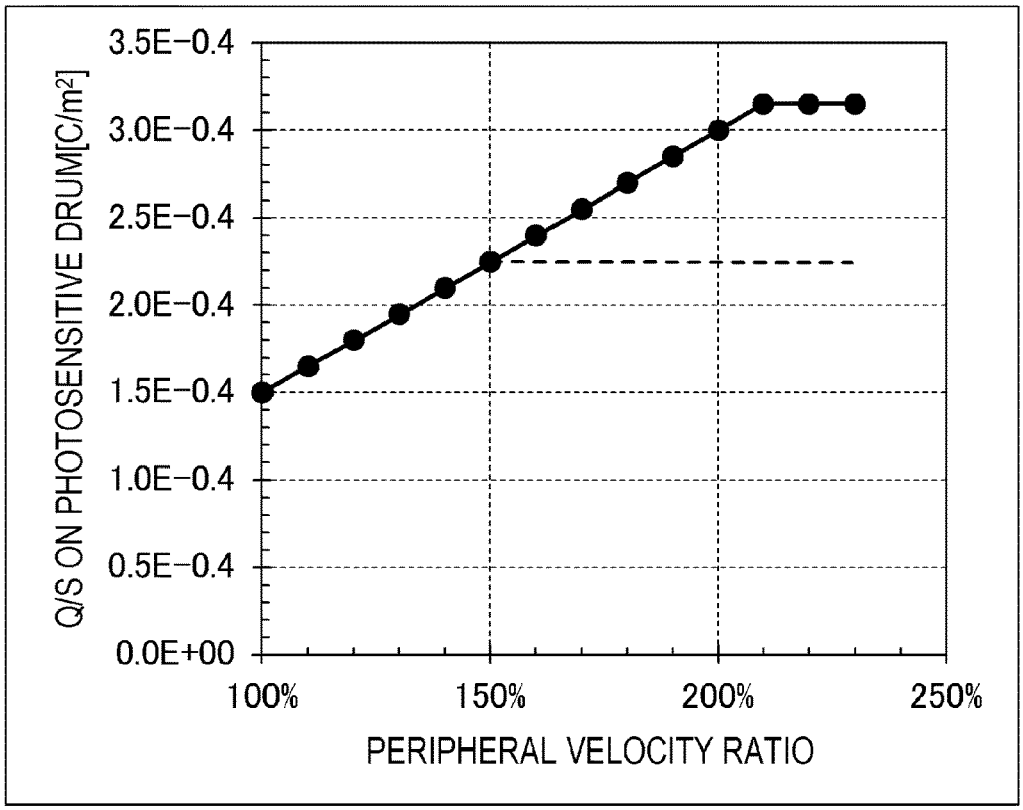

FIG. 1A shows the peripheral velocity ratio on a horizontal axis and M/S developed on the photosensitive drum as an image bearing member on a vertical axis. FIG. 1B similarly shows the peripheral velocity ratio on a horizontal axis and Q/S of toner developed on the photosensitive drum on a vertical axis. FIGS. 1A and 1B show that increases in M/S and Q/S relative to the peripheral velocity ratio slow down around a peripheral velocity ratio of 210%. In addition, a relationship between the peripheral velocity ratio when the development contrast ΔV is set to 150 V and M/S or Q/S is depicted by a dashed line. The slowdown indicates that, when charged toner is supplied to the photosensitive drum, an electrical gradient formed by the development contrast is moderated or eliminated by the charge of the toner and the supply of toner to portions with a light-part potential of the photosensitive drum enters a saturated state.

A development contrast in a developing nip portion is formed by a dark-part potential and a light-part potential constituting an electrostatic latent image formed on the photosensitive drum and by a developing bias applied to the developing roller. Due to the development contrast, the toner on the developing roller is transferred to the photosensitive drum and develops the electrostatic image. An amount of toner supplied for development (a developable amount) due to the development contrast is determined by a product of capacitance (C) between the photosensitive drum and the developing roller at the developing nip portion which sandwiches the toner and the development contrast (ΔV) with respect to a total electrified charge amount of the supplied toner. In other words, C×ΔV represents a total electrified charge amount of the toner per unit area which can be transferred from the developing roller to the photosensitive drum (which can be supplied for development) in the developing nip portion which is an opposing portion where the developing roller and the photosensitive drum oppose each other. In addition, the total electrified charge amount of the toner supplied to the photosensitive drum is determined in accordance with the electrified charge amount (Q/S) per unit area on the developing roller and a peripheral velocity ratio (Δv) with respect to the photosensitive drum and is expressed as a product Q/S×Δv.

From the above, an amount of toner which can be supplied for development with respect to the development contrast can be expressed by a relational expression of $|Q/S\times\Delta v|=|C\times\Delta V|$. In other words, when the peripheral velocity ratio Δv is varied and $|Q/S\times\Delta v|\leq|C\times\Delta V|$ is satisfied, a total charge amount of the toner supplied from the developing roller is smaller than a charge amount which can be accepted by the photosensitive drum. This case constitutes a condition under which all of the toner on the developing roller is transferred to the photosensitive drum (supplied for development). Conversely, when $|Q/S\times\Delta v|>|C\times\Delta V|$ is satisfied, the total charge amount of the toner supplied from the developing roller is larger than the charge amount which can be accepted by the photosensitive drum. This case constitutes a condition under which while a part of the toner corresponding to the charge amount which satisfies $|Q/S\times\Delta v|=|C\times\Delta V|$ is used for development, the rest of the toner remains on the developing roller after (immediately after) the development operation instead of being used for development.

As shown in FIGS. 1A and 1B, when ΔV=200 V, M/S on the photosensitive drum slows down under a condition of Δv=210 [%] and Q/S×Δv takes a value around $-0.32\times10^{-3}$. Therefore, from the relationship expressed as $|Q/S\times\Delta v|=|C\times\Delta V|$, the capacitance C which is a product of a capacity between the photosensitive drum and the developing roller takes a value of $1.6\times10^{-6}$.

The toner image developed on the photosensitive drum is eventually transferred to and fixed on recording material. FIG. 4 represents a relationship between a development amount of toner and density at the time of fixing. From FIGS. 1 and 4, it was confirmed that a density of 1.45 (Macbeth RD-918) generally required in office documents is obtained by setting the peripheral velocity ratio to 120%. It was found that, by further increasing the peripheral velocity ratio, a density of 1.72 is reached at a peripheral velocity ratio of 200% and, while the density subsequently continues to vary, an amount of variation is not large. In consideration thereof, in the present embodiment, as a first peripheral velocity ratio, a peripheral velocity ratio in the normal mode (mode A) intended for office applications and the like is set to 120% at which a density of 1.45 is output. For example, when the peripheral velocity of the photosensitive drum is 200 mm/sec, the peripheral velocity of the developing roller is 240 mm/sec. In addition, as a second peripheral velocity ratio, a peripheral velocity ratio in the high-density mode (mode B) according to the present embodiment is set to 240% as a condition under which development residual toner is created while producing a density of 1.7 or higher. For example, when the peripheral velocity of the photosensitive drum is 200 mm/sec, the peripheral velocity of the developing roller is 480 mm/sec. Moreover, in the present embodiment, since the photosensitive drum 201 and the developing roller 302 rotate in a same direction in the contact portion C1, the peripheral velocity ratio takes a positive value. Therefore, in an apparatus configuration in which the photosensitive drum 201 and the developing roller 302 rotate in opposite directions in the contact portion C1, the peripheral velocity ratio takes a negative value. In the present embodiment, a peripheral velocity ratio is obtained with reference to a contact portion at which the photosensitive drum and the developing roller are in contact with each other. However, this method is not restrictive and, in the case of an apparatus configuration in which the photosensitive drum and the developing roller do not come into contact with each other, a position corresponding to a distance of closest approach between the photosensitive drum and the developing roller may be considered an opposing portion and a rotation direction may be specified and a peripheral velocity ratio may be calculated with reference to the opposing portion. It was confirmed that, under the condition described above, a state where toner remains on the developing roller is created even immediately after a development operation of a high printing pattern such as a solid black image. It was also confirmed that a density of 1.75 which is sufficiently high is outputted and M/S of toner remaining on the developing roller immediately after the development operation was approximately $0.4\times10^{-3}$ kg/m$^2$. On the other hand, as a comparative example, when the peripheral velocity ratio in the high-density mode is set to Δv=200% which is a conventional peripheral velocity ratio at which no development residue is created, it was confirmed that a state where there is no residual toner on the developing roller immediately after a development operation is created when forming a high printing pattern such as a solid black image while obtaining a density of around 1.72.

In each mode, 50 sheets of A4 paper were used to consecutively print a full-size solid black image and the presence or absence of variations in solid density or non-uniformity during the printing was confirmed. In addition, solid density was measured at four corners of a sheet of A4 paper using a density measuring instrument. A "good" score was given when image density non-uniformity within the sheet was lower than 0.1 due to low visibility, otherwise a "not good" score was given. Results thereof are shown in Table. 1.

TABLE 1

| | DENSITY | RELATIONAL EXPRESSION | DEVELOPMENT RESIDUE | 1ST SHEET | 10TH SHEET | 20TH SHEET | 30TH SHEET | 40TH SHEET | 50TH SHEET |
|---|---|---|---|---|---|---|---|---|---|
| MODE A | 1.43~1.46 | Q/SΔv ≤ CAV | ABSENT | GOOD | GOOD | GOOD | GOOD | GOOD | GOOD |
| EMBODIMENT MODE B | 1.74~1.76 | Q/SΔv > CAV | PRESENT | GOOD | GOOD | GOOD | GOOD | GOOD | GOOD |
| COMPARATIVE EXAMPLE MODE B | 1.41~1.74 | Q/SΔv ≤ CAV | ABSENT | GOOD | GOOD | NOT GOOD | NOT GOOD | NOT GOOD | NOT GOOD |

Table 1 shows a presence or absence of development residue together with relational expressions. As shown in Table 1, in the embodiment, across results of 50 consecutive sheets, a level of image density non-uniformity within pages was favorable while density was maintained in each of the pages. In contrast, in a comparative example which is a conventional example, image density non-uniformity was observed at a rear end portion of the images starting from the 20th sheet. The level of image density non-uniformity was not a level of blank dots at which the image completely disappears but rather in a state resembling a hazy image in which the rear end portion had a density ranging from around 1.4 to around 1.6 as compared to an overall density of 1.7.

According to the present embodiment, when forming a solid image, by adopting an operating condition under which development residual toner is formed instead of an operating condition under which development residual toner is not formed as was conventional, density stability can be obtained in a case where image formation is consecutively performed. It is conceivable that, by increasing a toner supply amount and retaining, as development residue toner, a part of toner to which charges are imparted in the process of adhering to the developing roller, adherence of toner attracted by the charge of the development residue toner to the developing roller proceeds to inhibit the creation of image density non-uniformity. Moreover, in the development setting which allows development residue toner to be formed according to the present embodiment, image density non-uniformity due to a fluctuation in applied bias described earlier is a concern. However, as shown in FIG. 4, even when M/S fluctuation occurs in a high-density region, since density fluctuation is small, an effect of a fluctuation in applied bias on density change is small.

As described above, in the present embodiment, when adopting a high-density mode or a mode intended to increase tinge, the CPU 215 which is a controller adjusts the peripheral velocity ratio Δv based on a relationship expressed as $|Q/S \times \Delta v| = |C \times \Delta V|$ and forms development residual toner on the developing roller. Accordingly, even a high-density image can be printed in a stable manner without creating image density non-uniformity. Note that the various operation settings described in the present embodiment are merely examples. What is important is whether or not a development contrast formed by a light-part potential of a photosensitive drum and a developing bias can be completely eliminated by toner having electrified charges during development (whether or not development residual toner can be formed) and, as long as this holds true, other setting conditions may be adopted.

[Description of Enlargement of Color Gamut]

Figure 5:
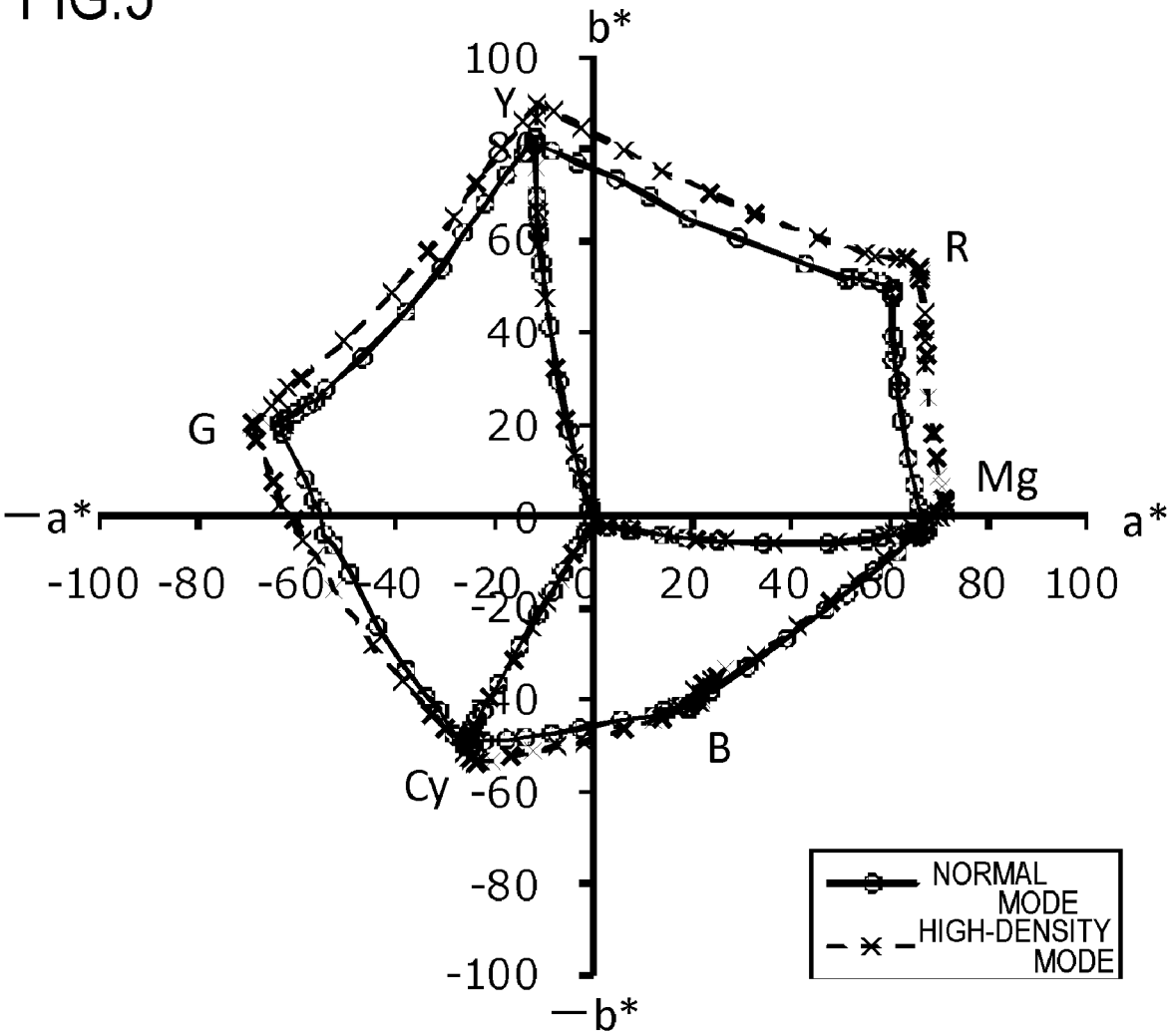
FIG. 5 is a chromaticity diagram according to an embodiment of the present invention.

FIG. 5 is a chromaticity diagram comparatively showing a color gamut when forming a color image in the normal mode and a color gamut when forming a color image in the high-density mode. The L*a*b* color system (CIE) was used to assess the color gamuts. In addition, chromaticity was measured using Spectordensitometer 500 manufactured by X-Rite, Incorporated. FIG. 5 shows a change in color gamuts when control in the high-density mode according to the present invention is performed in a same manner on the respective process cartridges of yellow (Y), magenta (Mg), and cyan (Cy) which constitute basic colors in color image formation. It is shown that, by switching from the normal mode to the high-density mode, for example, a color gamut of red (R) formed by yellow (Y) and magenta (Mg) and a color gamut of green (G) formed by yellow (Y) and cyan (Cy) have been enlarged.

Moreover, the high-density mode according to the present invention is also applicable when only a color gamut of a specific tinge is enlarged. For example, when only enlarging a color gamut of blue (B) formed by magenta (Mg) and cyan (Cy), the high-density mode according to the present invention may be performed only on the process cartridges of magenta and cyan among the four process cartridges. Accordingly, an enlargement of a color gamut of a specific tinge can be more reliably realized without causing a shortage of a toner supply amount. In addition, the present invention is also applicable to cases of controlling tinge adjustment so that rates of increasing a toner laid-on level per unit area are differentiated among process cartridges. In other words, by performing the control according to the present invention when performing the high-density mode in order to adjust a ratio of toner laid-on levels per unit area between process cartridges to a prescribed ratio, the prescribed ratio can be more reliably realized without causing a shortage of a toner supply amount. As a result, finer adjustment of tinge can be reliably performed.

Second Embodiment

In the first embodiment described above, when performing a high-density mode, an operating condition which enables toner to remain on a developing roller even during printing of a high printing pattern such as solid black is adopted to realize stabilization of density and tinge while maintaining supplying performance of toner to the developing roller. A second embodiment of the present invention is configured such that, when an electrified charge amount of toner changes due to a change in the toner accompanying environmental conditions or specifications, peripheral velocity ratio control corresponding to the change is performed so that similar effects are obtained regardless of changes in conditions and the like. Specifically, an image forming apparatus according to the second embodiment includes a sensor 219 as detecting means configured to detect temperature and humidity (refer to FIG. 2). In addition, a CPU 315 assumes a low temperature, low humidity environment when the temperature detected by the sensor 219 is equal to or lower than a prescribed temperature and the humidity detected by the sensor 219 is equal to or lower than a prescribed humidity and performs control necessary in a low temperature, low humidity environment to be described later. On the other hand, the CPU 315 assumes a high temperature, high humidity environment when the temperature detected by the sensor 219 is equal to or higher than a prescribed temperature and the humidity detected by the sensor 219 is equal to or higher than a prescribed humidity and performs control necessary in a high temperature, high humidity environment to be described later. Moreover, in the second embodiment, only differences from the first embodiment will be described. Matters not described in the second embodiment are similar to those described in the first embodiment.

First, in the configuration of the first embodiment described above, the presence or absence image density non-uniformity and of development residue were confirmed in a high temperature, high humidity environment in which an electrified charge of toner is less readily obtained and in a low temperature, low humidity environment in which an electrified charge of toner is more readily obtained. Table 2 represents a result thereof.

TABLE 2

| | AVERAGE DENSITY | DEVELOPMENT RESIDUE | 1ST SHEET | 10TH SHEET | 20TH SHEET | 30TH SHEET | 40TH SHEET | 50TH SHEET |
|---|---|---|---|---|---|---|---|---|
| 1ST EMBODIMENT NORMAL TEMPERATURE, NORMAL HUMIDITY | 1.75 | PRESENT | GOOD | GOOD | GOOD | GOOD | GOOD | GOOD |
| LOW TEMPERATURE, LOW HUMIDITY | 1.65 | SIGNIFICANT | GOOD | GOOD | GOOD | GOOD | GOOD | GOOD |
| HIGH TEMPERATURE, HIGH HUMIDITY | 1.77 | ABSENT | GOOD | GOOD | NOT GOOD | NOT GOOD | NOT GOOD | NOT GOOD |

In the present embodiment: an environment with a temperature of 25° C. and a humidity of 60% RH is assumed as a normal temperature, normal humidity environment; an environment with a temperature of 15° C. and a humidity of 10% RH is assumed as the low temperature, low humidity environment; and an environment with a temperature of 30° C. and a humidity of 80% RH is assumed as the high temperature, high humidity environment. Thresholds for determining the low temperature, low humidity environment are set to a temperature of 20° C. (first threshold temperature) and a humidity of 30% RH (first threshold humidity) and, when detected values are equal to or lower than 20° C. and equal to or lower than 30% RH, the CPU 315 determines that an apparatus environment is the low temperature, low humidity environment. In addition, thresholds for determining the high temperature, high humidity environment are set to a temperature of 28° C. (second threshold temperature) and a humidity of 70% RH (second threshold humidity) and, when detected values are equal to or higher than 28° C. and equal to or higher than 70% RH, the CPU 315 determines that an apparatus environment is the high temperature, high humidity environment. Moreover, boundaries of temperature and humidity which affect an electrified charge of toner are to be changed as appropriate in accordance with a material of the toner, apparatus configuration, and the like. As shown in Table 2, in the high temperature, high humidity environment, while the density was around 1.7 which is slightly higher than in the normal temperature, normal humidity environment, an amount of development residual toner was depleted and image density non-uniformity occurred. In addition, in the low temperature, low humidity environment, although image density non-uniformity did not occur, the density was around 1.65 which is slightly lower than in the normal temperature, normal humidity environment.

M/S and Q/S on the developing roller are similarly confirmed. Table 3 represents a result thereof.

TABLE 3

| | M/S[kg/m$^2$] | Q/S[C/m$^2$] | Q/M[C/kg] |
|---|---|---|---|
| 1ST EMBODIMENT NORMAL TEMPERATURE, NORMAL HUMIDITY | $3.0 \times 10^{-3}$ | $-0.15 \times 10^{-3}$ | $-0.050 \times 10^{-3}$ |
| LOW TEMPERATURE, LOW HUMIDITY | $3.0 \times 10^{-3}$ | $-0.20 \times 10^{-3}$ | $-0.067 \times 10^{-3}$ |
| HIGH TEMPERATURE, HIGH HUMIDITY | $3.0 \times 10^{-3}$ | $-0.14 \times 10^{-3}$ | $-0.047 \times 10^{-3}$ |

Table 3 shows that, compared to the normal temperature, normal humidity environment, while M/S is unchanged, Q/S has changed. In other words, an electrified charge amount (hereinafter, denoted by Q/M which is expressed by Q/M=(Q/S)/(M/S)) per unit weight of toner has changed. Specifically, Q/M decreases in the high temperature, high humidity environment and increases in the low temperature, low humidity environment. This represents a result of the change described above causing Q/S in the relational expression $|Q/S \times \Delta v| = |C \times \Delta V|$ to change as described in the first embodiment which, in turn, causes changes in a developable toner amount and a residual amount on the developing roller immediately after a development operation. In consideration thereof, the development contrast is optimized so as to maintain density and a residual toner amount on the developing roller immediately after a development operation at constant levels even when the environment changes and, accordingly, Q/M of toner changes.

As described in the first embodiment, a development contrast in the normal temperature, normal humidity environment is $\Delta V = 200$ V as a first development contrast. Meanwhile, when calculating $\Delta V$ based on the change in Q/S and the relational expression $|Q/S \times \Delta v| = |C \times \Delta V|$, $\Delta V$ in the high temperature, high humidity environment as a third development contrast is calculated as 180 V which is lower than that in the normal temperature, normal humidity environment. In a similar manner, ΔV in the low temperature, low humidity environment as a second development contrast is calculated as 260 V. In the present embodiment, the development contrasts ΔV under the conditions described above were adjusted by finely adjusting a laser light amount. Specifically, the development contrasts ΔV were adjusted to desired values by fixing the developing bias to −300 V and the dark-part potential to −500 V (in other words, fixing the charging bias) and changing the light-part potential which changes with an increase or decrease of the laser light amount from −100 V in the normal temperature, normal humidity environment. Results thereof are shown in Table. 4. Moreover, the development contrast ΔV may be changed by adjusting the developing bias or the charging bias instead of adjusting the laser light amount or by adjusting the developing bias or the charging bias in addition to adjusting the laser light amount.

TABLE 4

| | AVERAGE DENSITY | DEVELOPMENT RESIDUE | 1ST SHEET | 10TH SHEET | 20TH SHEET | 30TH SHEET | 40TH SHEET | 50TH SHEET |
|---|---|---|---|---|---|---|---|---|
| 1ST EMBODIMENT NORMAL TEMPERATURE, NORMAL HUMIDITY | 1.75 | PRESENT | GOOD | GOOD | GOOD | GOOD | GOOD | GOOD |
| LOW TEMPERATURE, LOW HUMIDITY | 1.74 | PRESENT | GOOD | GOOD | GOOD | GOOD | GOOD | GOOD |
| HIGH TEMPERATURE, HIGH HUMIDITY | 1.75 | PRESENT | GOOD | GOOD | GOOD | GOOD | GOOD | GOOD |

Table 4 shows that, by finely adjusting the laser light amount and changing the development contrast, development residual toner can be formed in a similar manner to the normal temperature, normal humidity environment. As an effect thereof, it was confirmed that an occurrence of image density non-uniformity can be suppressed in addition to suppressing changes in density.

While the present embodiment describes that, when an electrified charge amount (Q/M) of toner changes in accordance with a fluctuation in the environment, a similar effect is produced with respect to density and image density non-uniformity by appropriately adjusting the development contrast with a laser light amount, this method is not restrictive. As described above, as means for adjusting the development contrast, for example, a similar effect may be produced by adjusting a charging bias or a developing bias. In addition, a cause of a change in the electrified charge amount (Q/M) of toner is not limited to a change in the environment and may also be caused by, for example, a frequency of use. Therefore, a similar effect can be produced by taking similar actions in accordance with a change in the frequency of use.

Third Embodiment

Figure 7:
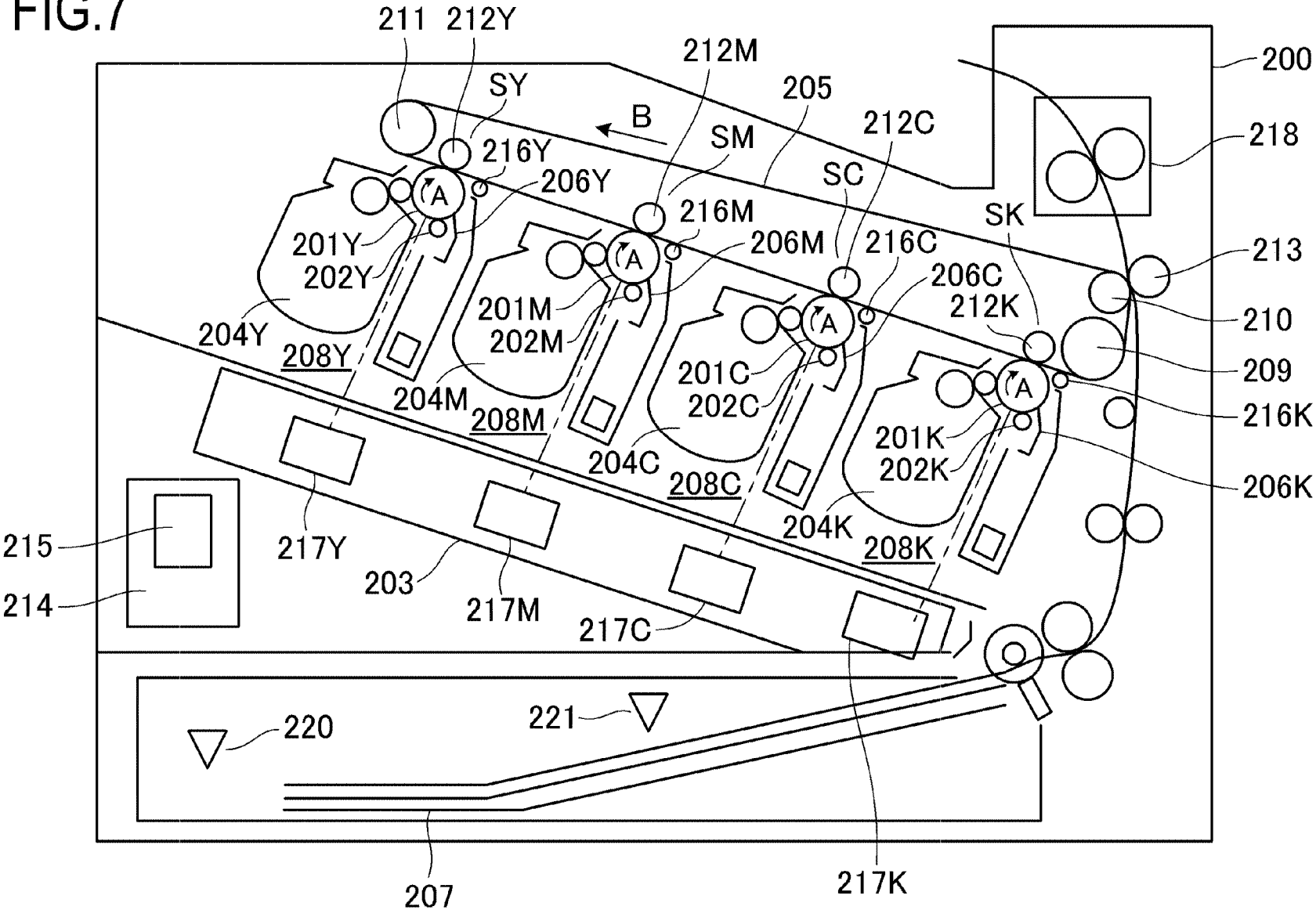
FIG. 7 is a schematic view of an image forming apparatus according to third and fourth embodiments of the present invention.

FIG. 7 is a schematic sectional view of an image forming apparatus according to a third embodiment of the present invention. The image forming apparatus 200 according to the third embodiment includes, in addition to the configuration of the image forming apparatus according to the first embodiment, a recording material type detection sensor 220 which detects a width of the recording material 207 in a sub-scanning direction and a recording material type detection sensor 221 which detects a width of the recording material 207 in a main scanning direction. In the third embodiment, only differences from the first and second embodiments will be described. Matters not described in the third embodiment are similar to those described in the first and second embodiments.

Figure 8:
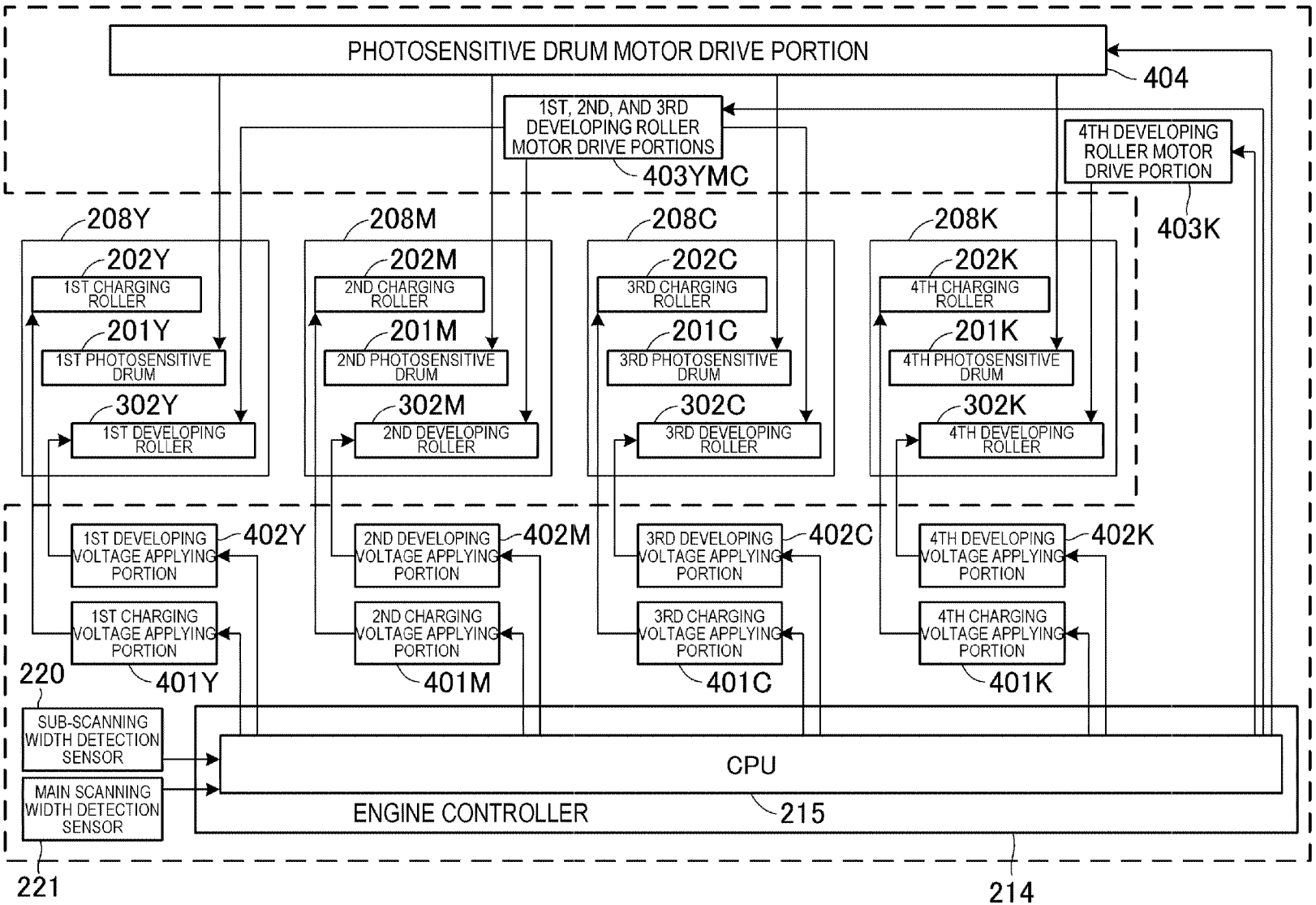
FIG. 8 is a block diagram according to the third and fourth embodiments of the present invention.

FIG. 8 is a block diagram showing driving and high-voltage control of the photosensitive drum 201 and the developing roller 302 of the image forming apparatus according to the third embodiment. In FIG. 8, signals are sent from the CPU 215 of the engine controller 214 to the respective voltage applying portions 401 and 402 and the respective motor drive portions 403 and 404. First, by sending a signal to the charging voltage applying portion 401 to cause DC voltage to be applied to the charging roller 202 and inducing discharge between the charging roller 202 and the photosensitive drum 201, the CPU 215 forms a uniform dark-part potential (Vd) on the surface of the photosensitive drum 201. A laser 217 spot pattern which is emitted from the laser 217 in the scanner unit 203 in correspondence with image data exposes the photosensitive drum 201, and a potential of an exposed portion drops and assumes a light-part potential (Vl). Next, the CPU 215 sends a signal to the developing voltage applying portion 402 to cause DC voltage to be applied to the developing roller 302, and causes the toner 305 to be transferred to the light-part potential (Vl) of the photosensitive drum 201. At this point, signals have been sent from the CPU 215 to the photosensitive drum motor drive portion 404 and the developing roller motor drive portion 403 to drive the photosensitive drum 201 and the developing roller 302 at a prescribed number of rotations. A type of the recording material 207 is detected by the CPU 215 based on detection values of the sensors (220 and 221) which detect recording material widths in the main scanning and sub-scanning directions of the recording material 207.

Figure 9:
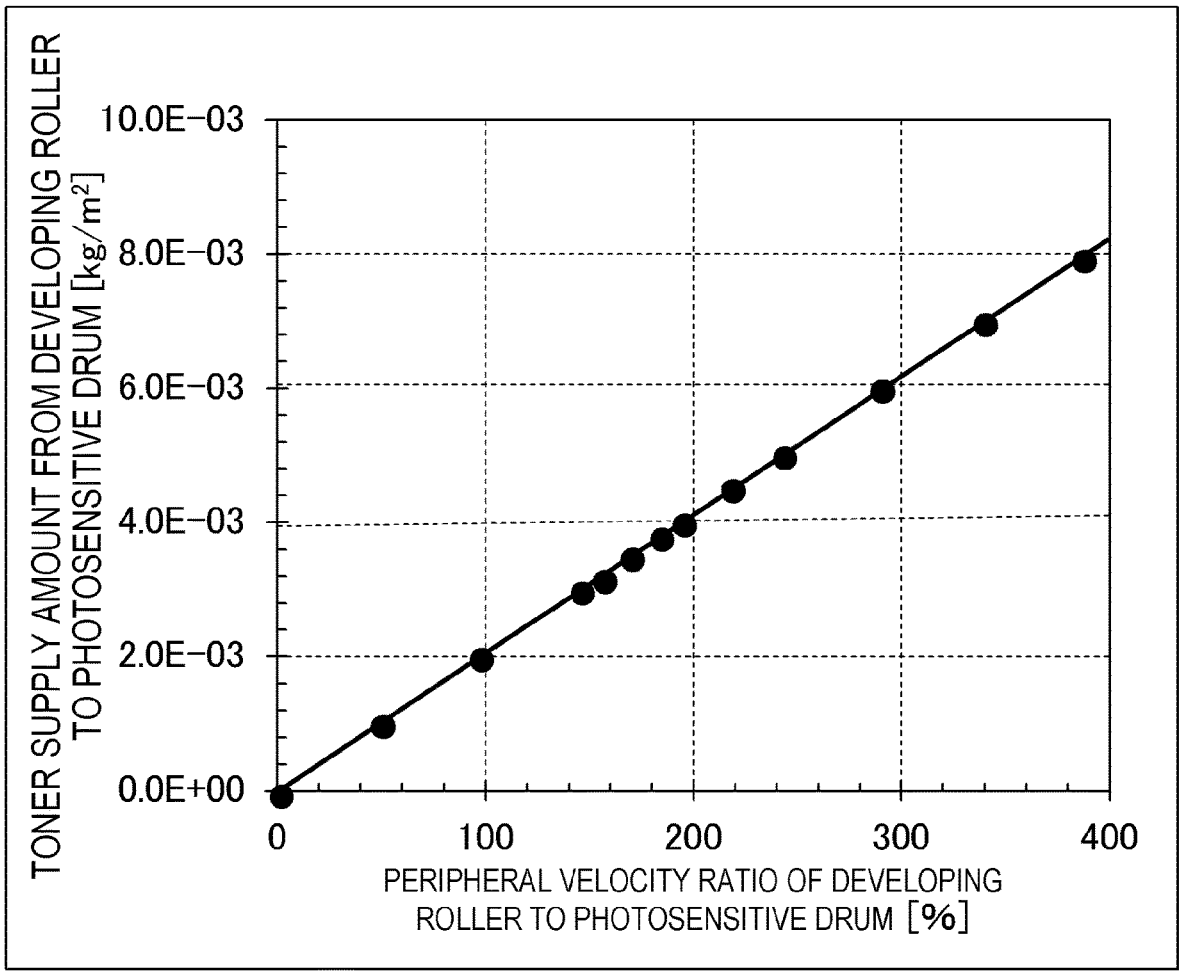
FIG. 9 is a characteristic diagram of a peripheral velocity of a developing roller with respect to a photosensitive drum and a toner coating amount of the developing roller.

FIG. 9 is a characteristic diagram showing a relationship between a peripheral velocity ratio which is a ratio of a peripheral velocity of the developing roller 302 to a peripheral velocity of the photosensitive drum 201 and a toner supply amount [kg/m$^2$] from the developing roller 302 to the photosensitive drum 201 when printing a solid black image, according to the third embodiment. FIG. 9 shows that, when the peripheral velocity ratio is increased, the toner amount supplied from the developing roller 302 to the photosensitive drum 201 increases.

Figure 10:
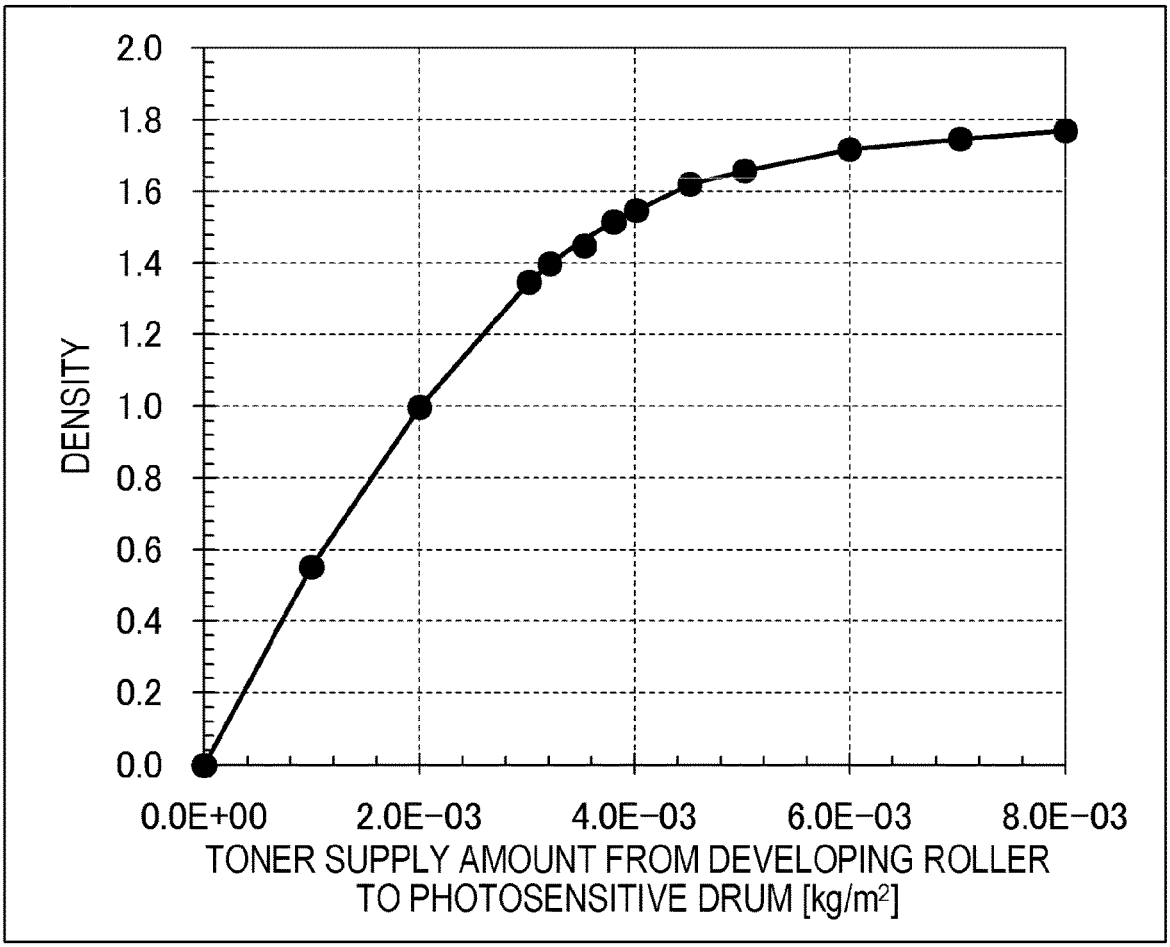
FIG. 10 is a characteristic diagram of a toner coating amount [kg/m$^2$] on a developing roller and image formation density.

FIG. 10 is a characteristic diagram showing a relationship between the toner supply amount [kg/m$^2$] from the developing roller 302 to the photosensitive drum 201 and image formation density. FIG. 10 shows that, when the toner amount supplied from the developing roller 302 to the photosensitive drum 201 is increased, the density during image formation increases.

Figure 11:
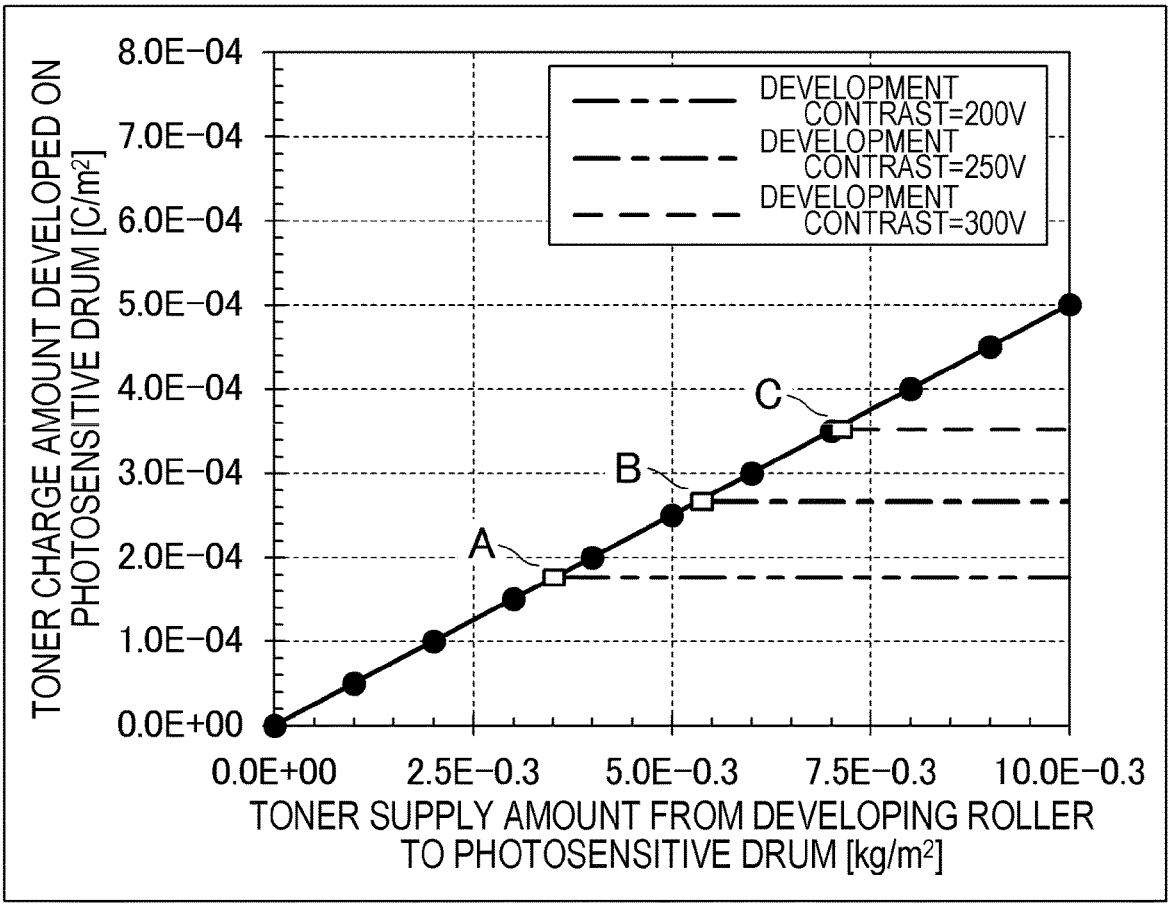
FIG. 11 is a characteristic diagram of a toner coating amount and a toner charge amount of a developing roller.

FIG. 11 is a characteristic diagram showing a relationship between the toner supply amount [kg/m$^2$] from the developing roller 302 to the photosensitive drum 201 when the development contrast is variable and an electrified charge amount [C/m$^2$] of toner developed on the photosensitive drum 201. FIG. 11 shows the result in case a toner with an electrified charge amount −0.05 [C/m$^2$] is used. FIG. 11 shows that a setting is adopted such that, when the development contrast is 200 V, a development efficiency at point A is 100% or, in other words, all of the toner supplied from the developing roller to the photosensitive drum is used to develop an electrostatic image on the photosensitive drum. Beyond point A, the development efficiency becomes lower than 100% or, in other words, apart of the toner supplied from the developing roller to the photosensitive drum is not used to develop an electrostatic image. Settings are respectively adopted such that, when the development contrast is 250 V and 300 V, the development efficiency at points B and C is 100% and, beyond points B and C, the development efficiency becomes lower than 100%.

In other words, for example, when the development contrast is 200V, even if the toner supply amount [kg/m$^2$] from the developing roller 302 to the photosensitive drum 201 is further increased from point A, latent image charges on the photosensitive drum 201 are filled up before all of the toner is used up. Therefore, a part of the supplied toner is not transferred onto the photosensitive drum 201 (not used for development) and the development efficiency declines (becomes lower than 100% development efficiency) in the relationship of an amount used for development with respect to a supply amount. Moreover, when the development contrast is 250 V and 300 V, when the toner supply amount to the photosensitive drum 201 is similarly increased beyond points B and C, the development efficiency declines in a similar manner.

The development contrast is formed by the light-part potential (V1) on the photosensitive drum 201 and a prescribed DC bias (developing bias) applied to the developing roller 302 and decreases as toner is transferred from the developing roller 302 to the photosensitive drum 201. When all of the toner borne by the developing roller 302 is transferred to the photosensitive drum 201 and used for development and a charge amount [C/m$^2$] of the toner causes the development contrast to drop to 0 V, the development efficiency becomes 100%. In this case, a desired value of the development contrast is set using a supply amount [kg/m$^2$] of the toner 305 from the developing roller 302 to the photosensitive drum 201 in accordance with a target density, a charge amount [C/m$^2$] of the toner developed on the photosensitive drum 201, and the like. Various operation settings when the image forming apparatus according to the third embodiment performs image formation in the normal mode (normal image formation mode) which is a normal operation will be shown below.

TABLE 5

| MODE | DEVELOPMENT CONTRAST [V] | PERIPHERAL VELOCITY RATIO [%] | DEVELOPMENT EFFICIENCY [%] | TARGET DENSITY |
|---|---|---|---|---|
| NORMAL MODE | 200 | 145 | 100 | 1.35 |

The operation settings in the normal mode shown in Table 5 are calculated as follows. For example, let us assume a target density setting of 1.35. In this case, FIG. 10 shows that, in order to obtain a density of 1.35, a toner supply amount from the developing roller 302 to the photosensitive drum 201 of 0.003 kg/m$^2$ is required. In addition, FIG. 9 shows that, in order to realize this toner supply amount, the developing roller 302 must be driven by the developing roller motor drive portion 403 so that the peripheral velocity ratio which represents the ratio of the peripheral velocity of the developing roller 302 to the peripheral velocity of the photosensitive drum 201 is 145%. Furthermore, FIG. 11 shows that the development contrast is set to 200 V in order to set the development efficiency to 100% in the toner supply amount described above.

According to the settings described above, in a high printing pattern such as solid black, a sufficient electrostatic latent image with respect to a charge amount of the toner 305 borne by the developing roller 302 can be formed and a development efficiency of 100% which enables all of the toner 305 coating the developing roller 302 to be transferred to the photosensitive drum 201 can be realized. Therefore, since residual toner of the coat of toner on the developing roller 302 after a development operation is almost depleted, when using a paper size or the like which necessitates consecutive image formation such as long paper, there is a concern that poor following performance (image density non-uniformity, color non-uniformity, or the like) may occur at rear ends of the sheets of paper. In consideration thereof, the third embodiment is configured such that, together with a normal image formation mode which realizes normal image quality used in offices or the like, a plurality of image formation modes which are selectable in accordance with use conditions of the user can be set. In the present third embodiment, as the plurality of image formation modes selectable by the user, a long paper mode is provided which is an operating mode when consecutively performing image formation on a plurality of sheets of long paper or, in other words, a plurality of sheets of recording material having a size in which a length in a recording material conveyance direction is relatively long.

Figure 6:
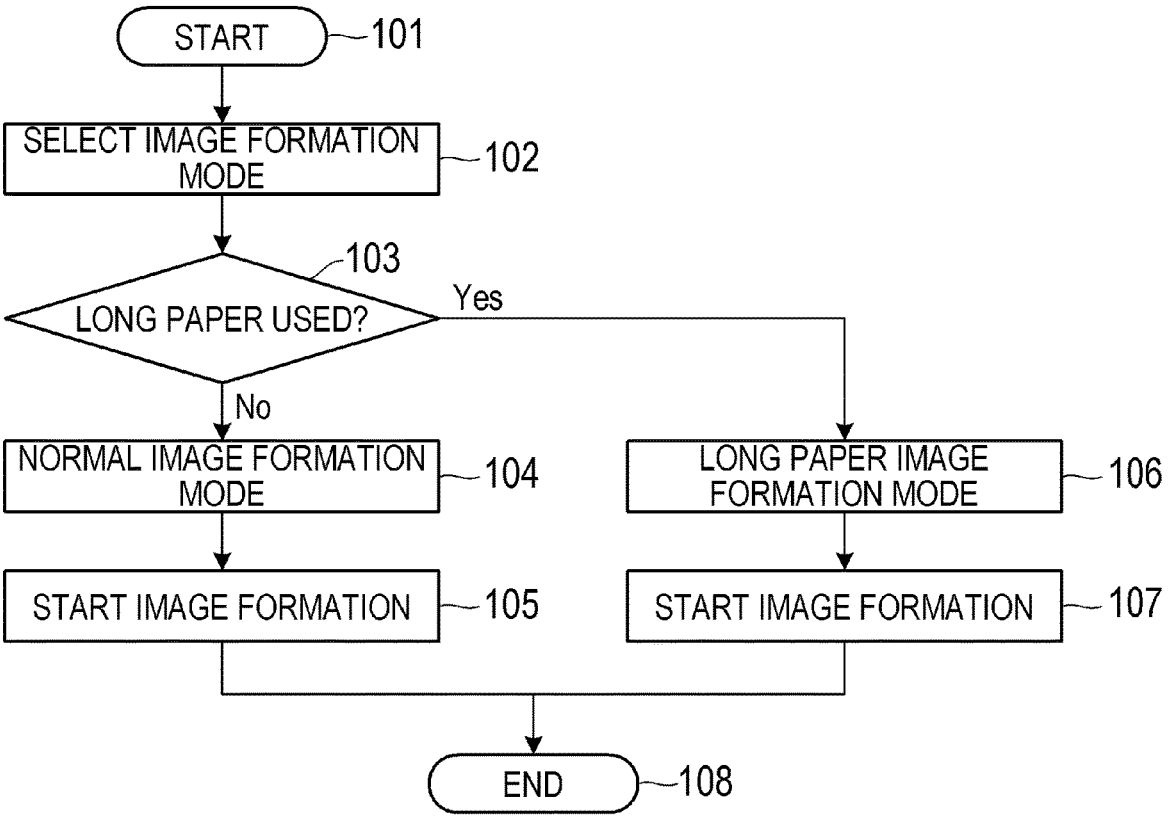
FIG. 6 is a flow chart according to a third embodiment of the present invention.

FIG. 6 is a flow chart during an image forming operation according to the third embodiment. In FIG. 6, the user selects an image formation mode (instructs the image forming apparatus to execute an image forming operation) (102). When the user does not select a mode (103: No), the CPU 215 selects the normal image formation mode (104) and starts an image forming operation (105). When the user selects the long paper image formation mode (103: Yes), the CPU 215 starts image formation in the long paper image formation mode (106 and 107). Hereinafter, operation settings of image formation when the user selects the long paper image formation mode according to the third embodiment will be shown.

TABLE 6

| MODE | DEVELOPMENT CONTRAST [V] | PERIPHERAL VELOCITY RATIO [%] | DEVELOPMENT EFFICIENCY [%] | TARGET DENSITY |
|---|---|---|---|---|
| NORMAL MODE | 200 | 145 | 100 | 1.35 |
| LONG PAPER MODE | 200 | 193 | 75 | 1.35 |

The operation settings in the long paper mode shown in Table 6 are calculated as follows. The poor following performance at the rear ends of the sheets of long paper which occurs when consecutively performing image formation on a plurality of sheets of long paper is caused when the development efficiency is set to 100% and all of the toner 305 coating the developing roller 302 is transferred to the photosensitive drum 201. In other words, in a latter half of consecutive image formation, the supply of the toner 305 from the developing roller 302 to the photosensitive drum 201 becomes unfollowable. Therefore, in the long paper mode described above, a toner coating amount on the developing roller 302 must be increased by increasing the peripheral velocity ratio between the photosensitive drum 201 and the developing roller 302 to make the supply of the toner 305 from the developing roller 302 to the photosensitive drum 201 followable.

In this case, in order to improve following performance with respect to the toner supply from the developing roller 302 to the photosensitive drum 201, the development efficiency must be set lower than 100%. By setting the development efficiency lower than 100%, the toner 305 remains on the developing roller 302 immediately after a development operation and produces an effect in which, due to a charge amount of the remaining toner 305, a larger proportion of the toner 305 supplied from the supplying roller 304 to the developing roller 302 can be attracted to the developing roller 302. Accordingly, the toner coating amount of the developing roller 302 can be maintained over a longer period during consecutive image formation and following performance with respect to the toner supply from the developing roller 302 to the photosensitive drum 201 can be improved.

To this end, in order to set the development efficiency lower than 100% and keep development residual toner on the developing roller 302 while satisfying following performance with respect to the toner 305 from the developing roller 302, a ratio (peripheral velocity ratio) of the peripheral velocity of the developing roller 302 to the peripheral velocity of the photosensitive drum 201 is increased. An amount by which the peripheral velocity ratio is increased is obtained as follows. For example, when the development efficiency is set to 75% as a setting of the development efficiency lower than 100%, FIG. 11 shows that the toner supply amount from the developing roller 302 to the photosensitive drum 201 in order to realize the development efficiency of 75% is 0.004 kg/m$^2$. In addition, FIG. 9 shows that the peripheral velocity ratio of the developing roller 302 to the photosensitive drum 201 necessary to realize the toner supply amount is 193%. Therefore, it is shown that the CPU 215 which is a controller need only drive the developing roller 302 with the developing roller motor drive portion 403 so that the peripheral velocity ratio is attained.

By setting the long paper mode described above, when using long paper with a width (length) in the sub-scanning direction of 1200 mm, poor following performance (image density non-uniformity, color non-uniformity, or the like) in rear ends of the sheets of paper which occurs in the normal mode can be suppressed. Moreover, the normal mode is an operating mode which assumes image formation to be mainly performed on recording material with regular sizes such as A5 and A4.

As described above, in the third embodiment, together with an image formation mode which realizes normal image quality, a long paper mode is provided as one of a plurality of image formation modes which are selectable in accordance with use conditions of the user. In addition, by adopting the operation settings according to the third embodiment described above, when consecutively performing image formation on a plurality of sheets of long paper, an occurrence of poor following performance (image density non-uniformity, color non-uniformity, or the like) in rear ends of the sheets of paper which sometimes occurs in the normal image formation mode can be suppressed. While the third embodiment is configured so that the long paper mode can be selected by the user, the configuration is not restrictive as long as a similar effect can be produced. For example, the image forming apparatus 200 itself may detect a paper type and the CPU 215 may automatically select the long paper mode.

While the third embodiment adopts a configuration in which a developing roller motor drive portion and a photosensitive drum motor drive portion are respectively shared or, in other words, four developing rollers are rotated by a single motor and four photosensitive drums are rotated by another single motor, a driving configuration is not limited thereto. As long as the operation settings in the long paper mode described above can be realized, for example, a configuration in which each developing roller and each photosensitive drum are respectively rotationally driven by independent motors can be adopted.

In addition, while a peripheral velocity ratio of the photosensitive drum 201 and the developing roller 302 is set by changing the number of rotations of the developing roller 302, the peripheral velocity ratio may be varied by changing the number of rotations of the photosensitive drum 201 while keeping the number of rotations of the developing roller 302 fixed. Alternatively, the peripheral velocity ratio may be variably controlled by changing both the number of rotations of the developing roller 302 and the number of rotations of the photosensitive drum 201. In this case, the peripheral velocity ratio may be changed by reducing both the number of rotations of the developing roller 302 and the number of rotations of the photosensitive drum 201 while differentiating amounts of reduction thereof.

In addition, while a development contrast of 200 V, a peripheral velocity ratio of 193%, and a development efficiency of 75% are adopted in the third embodiment as operation setting values in the long paper mode, appropriate setting values may naturally differ in accordance with apparatus configurations, operating conditions, or the like. The respective setting values may be changed as appropriate as long as similar effects to the third embodiment can be produced.

Fourth Embodiment

In the third embodiment, a long paper mode for accommodating long paper while maintaining similar values to a normal mode with respect to density is described as one of a plurality of image formation modes for increasing a tinge selection range or obtaining high density. In contrast, as yet another operating mode which is selectable by the user, a fourth embodiment of the present invention is provided with a high-density mode for increasing a tinge selection range and/or obtaining high density. In the high-density mode, various operation settings are designed to prevent the occurrence of poor following performance (image density non-uniformity, color non-uniformity, or the like). In the fourth embodiment, only differences from the third embodiment will be described. Matters not described in the fourth embodiment are similar to those described in the third embodiment.

Figure 12:
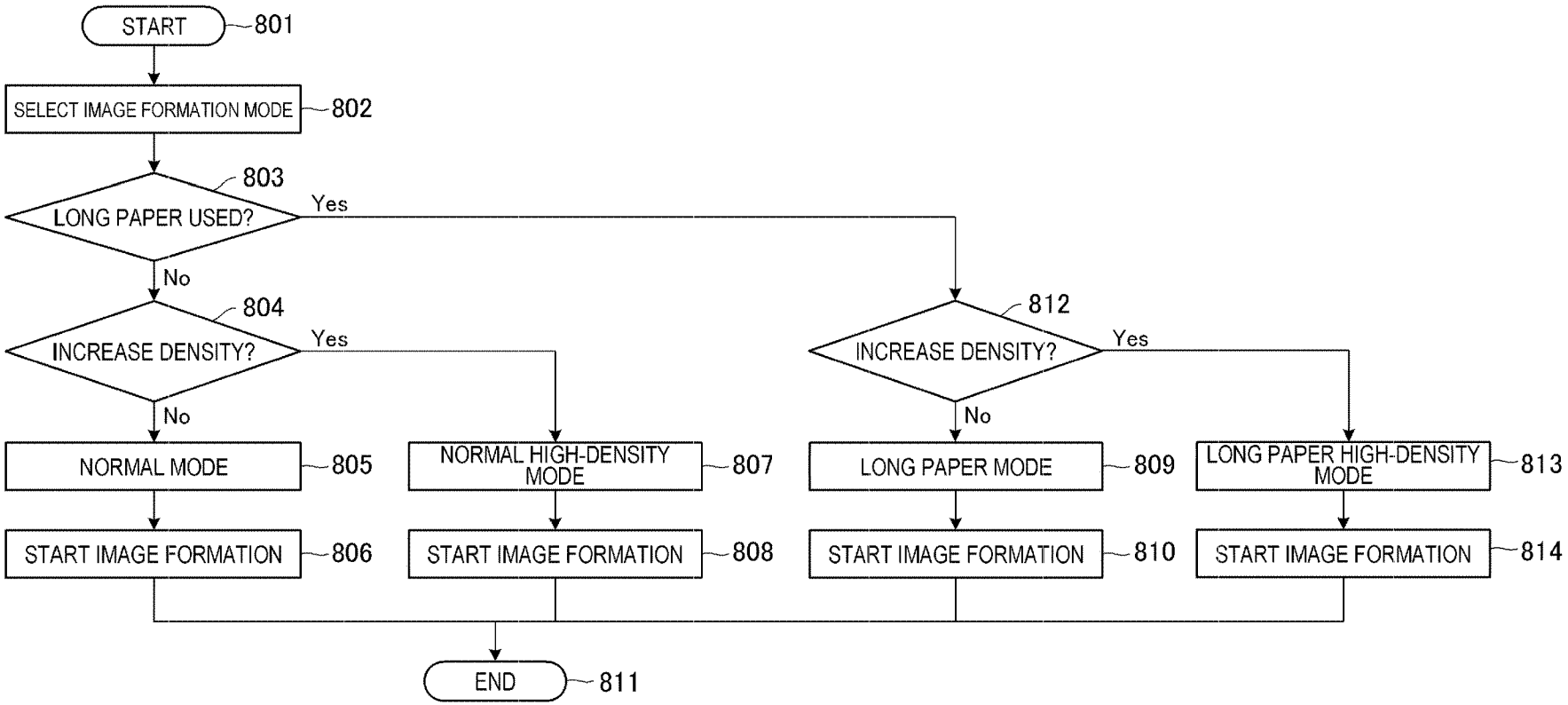
FIG. 12 is a flow chart according to the fourth embodiment of the present invention.

FIG. 12 is a flow chart during an image forming operation according to the fourth embodiment of the present invention. In FIG. 12, the user selects an image formation mode (instructs the image forming apparatus to execute an image forming operation) (802). When mode selection is not performed (803: No and 804: No), the CPU 215 starts an image forming operation in the normal image formation mode (805 and 806). When the user does not select the long paper image formation mode but selects the high-density image formation mode (803: No and 804: Yes), the CPU 215 starts image formation in the normal high-density image formation mode for regular size paper (807 and 808). When the user selects the long paper image formation mode and also selects the high-density image formation mode (803: Yes and 812: Yes), the CPU 215 starts image formation in the high-density image formation mode for long paper (813 and 814). When the user selects the long paper image formation mode but does not select the high-density image formation mode (803: Yes and 812: No), the CPU 215 starts image formation in the long paper image formation mode described in the third embodiment (809 and 810). Hereinafter, operation settings of image formation when the user selects the high-density image formation mode according to the fourth embodiment will be shown.

TABLE 7

| MODE | DEVELOPMENT CONTRAST [V] | PERIPHERAL VELOCITY RATIO [%] | DEVELOPMENT EFFICIENCY [%] | TARGET DENSITY |
|---|---|---|---|---|
| NORMAL MODE | 200 | 145 | 100 | 1.35 |
| LONG PAPER MODE | 200 | 193 | 75 | 1.35 |
| NORMAL HIGH-DENSITY MODE | 300 | 360 | 93 | 1.75 |
| LONG PAPER HIGH-DENSITY MODE | 300 | 483 | 75 | 1.75 |

The operation settings in the high-density modes shown in Table 7 are calculated as follows. For example, in the normal high-density mode, a target density thereof is set to 1.75 in consideration of market needs. Accordingly, FIG. 10 shows that, in order to satisfy the target density of 1.75, a toner supply amount from the developing roller 302 to the photosensitive drum 201 of 0.007 kg/m$^2$ is required. In addition, FIG. 11 shows that, in order to transfer 0.007 kg/m$^2$ of toner from the developing roller 302 to the photosensitive drum 201, a development contrast of 300 V is required. In this case, in order to print a high-density image without causing an occurrence of poor following performance (image density non-uniformity, color non-uniformity, or the like), the development efficiency must be set lower than 100%. In consideration thereof, the supply amount of the toner 305 from the developing roller 302 to the photosensitive drum 201 is set to 0.0075 kg/m$^2$. In order to set the supply amount of the toner 305 from the developing roller 302 to the photosensitive drum 201 to 0.0075 kg/m$^2$, FIG. 9 shows that the peripheral velocity ratio of the developing roller 302 to the photosensitive drum 201 must be set to 360%. Therefore, the developing roller 302 is driven by the developing roller motor drive portion 403 so that the peripheral velocity ratio of 360% is attained. As a result, the development efficiency becomes 93%. On the other hand, in the high-density mode for long paper, in order to attain the same target density of 1.75 as the normal high-density mode, the peripheral velocity ratio is increased to set the development efficiency lower than 100% for the purpose of improving following performance with respect to toner supply at a development contrast of 300V. Specifically, the peripheral velocity ratio is increased to 483% and the development efficiency is lowered to 75%.

By setting the high-density mode described above, when performing image formation on long paper, the density can be increased from 1.35 to 1.75 without causing an occurrence of poor following performance (image density non-uniformity, color non-uniformity, or the like) and a preferable high-density image can be obtained. In other words, an enlarged color gamut and an increased tinge selection range realized by the high-density mode described in the first embodiment can also be realized using long paper without causing image defects.

Moreover, while a density of 1.75, a development contrast of 300 V, a peripheral velocity ratio of 360%, and a development efficiency of 93% are adopted in the fourth embodiment as operation setting values in the normal high-density mode, appropriate setting values may naturally differ in accordance with apparatus configurations, operating conditions, or the like. In a similar manner, while a density of 1.75, a development contrast of 300 V, a peripheral velocity ratio of 483%, and a development efficiency of 75% are adopted in the fourth embodiment as operation setting values in the high-density mode for long paper, appropriate setting values may naturally differ in accordance with apparatus configurations, operating conditions, or the like. The respective setting values may be changed as appropriate as long as similar effects to the fourth embodiment can be produced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-057626, filed on Mar. 22, 2016, which is hereby incorporated by reference herein in its entirety.

What is claimed is:

1. An image forming apparatus, comprising:

an image bearing member;

a developer bearing roller configured to contact the image bearing member and perform a development operation in which an electrostatic image formed on the image bearing member is developed with a developer;

a motor configured to rotationally drive the image bearing member and the developer bearing roller respectively so that peripheral velocities of each is variable individually;

an exposure device configured to form an electrostatic image on the image bearing member by exposing a surface of the image bearing member at a predetermined exposure amount and by forming a light-part potential from a dark-part potential on the image bearing member;

a high-voltage power supply configured to apply a developing bias to the developer bearing roller; and a controller configured to control the developing bias and the exposure amount, wherein when a peripheral velocity ratio is defined as a ratio of the peripheral velocity of the developer bearing roller to the peripheral velocity of the image bearing member, the motor is configured to drive the image bearing member and the developer bearing roller at a first peripheral velocity ratio and a second peripheral velocity ratio which is larger than the first peripheral velocity ratio, and the controller controls the exposure amount so that a second development contrast formed between the developing bias to the developer bearing roller and the light-part potential formed on the image bearing member in a case where the development operation is performed at the second peripheral velocity ratio is larger than a first development contrast formed between the developing bias to the developer bearing roller and the light-part potential formed on the image bearing member in a case where the development operation is performed at the first peripheral velocity ratio.

2. The image forming apparatus according to claim 1, wherein the first peripheral velocity ratio and the second peripheral velocity ratio are set so that an amount of the developer remaining on the developer bearing roller after the development operation in a case where the development operation is performed at the second peripheral velocity ratio is larger than that in a case where the development operation is performed at the first peripheral velocity ratio.

3. The image forming apparatus according to claim 1, further comprising a sensor configured to detect temperature and humidity, wherein when a temperature detected by the sensor is equal to or lower than a prescribed temperature and a humidity detected by the sensor is equal to or lower than a prescribed humidity, the exposure device changes the light-part potential or the high-voltage power supply changes a magnitude of the developing bias to be applied so that the second development contrast which is larger than the first development contrast is formed.

4. The image forming apparatus according to claim 3, wherein when a temperature detected by the sensor is equal to or higher than the prescribed temperature and a humidity detected by the sensor is equal to or higher than the prescribed humidity, the exposure device changes the light-part potential so that a third development contrast which is smaller than the first development contrast is formed.

5. The image forming apparatus according to claim 1, wherein the motor is configured to rotate the image bearing member and the developer bearing roller so that the image bearing member and the developer bearing roller move in a same direction at an opposing portion where the image bearing member and the developer bearing roller oppose each other.

6. The image forming apparatus according to claim 1, wherein the motor is configured to:

set the peripheral velocity of the image bearing member, in a case of the first peripheral velocity ratio, to be the same as the peripheral velocity of the image bearing member in a case of the second peripheral velocity ratio; and set the peripheral velocity of the developer bearing roller higher, in the case of the second peripheral velocity ratio, to be larger than the peripheral velocity of the image bearing member in the case of the first peripheral velocity ratio.

7. The image forming apparatus according to claim 1, wherein the motor is configured to:

set the peripheral velocity of the developer bearing roller in a case of the first peripheral velocity ratio, to be the same as that in a case of the second peripheral velocity ratio; and set the peripheral velocity of the image bearing member lower, in the case of the second peripheral velocity ratio, to be larger than that in the case of the first peripheral velocity ratio.

8. The image forming apparatus according to claim 1, wherein the motor is configured to make the second peripheral velocity ratio larger than the first peripheral velocity ratio by:

setting the peripheral velocity of the developer bearing roller lower in a case of the second peripheral velocity ratio than that in a case of the first peripheral velocity ratio; and setting the peripheral velocity of the image bearing member lower in the case of the second peripheral velocity ratio than that in the case of the first peripheral velocity ratio, wherein an amount of reduction of the peripheral velocity of the developer bearing roller is different from an amount of reduction of the peripheral velocity of the image bearing member.

9. The image forming apparatus according to claim 1, wherein the first peripheral velocity ratio and the second peripheral velocity ratio are set so that an image can be formed at the second peripheral velocity ratio on a recording material longer than the one on which an image is formed at the first peripheral velocity ratio.

10. The image forming apparatus according to claim 1, wherein the first peripheral velocity ratio and the second peripheral velocity ratio are set so that a laid-on level of the developer per unit area of an image formed on a recording material in a case of the second peripheral velocity ratio is higher than that in a case of the first peripheral velocity ratio.

11. The image forming apparatus according to claim 1, further comprising:

a supplying roller configured to supply a developer to the developer bearing roller;

a developing chamber in which the supplying roller is arranged;

a housing chamber configured to communicate with the developing chamber and house the developer; and a stirring member arranged in the housing chamber and configured to convey the developer toward the developing chamber, wherein a communication port through which the developing chamber and the housing chamber communicate is positioned above the stirring member in the housing chamber.

12. The image forming apparatus according to claim 1, wherein when $\Delta v1$ denotes the peripheral velocity ratio of the first peripheral velocity ratio, $\Delta v2$ denotes the peripheral velocity ratio of the second peripheral velocity ratio, the image bearing member can increase a charge amount of developer to be developed on the image bearing member as the first peripheral velocity ratio increases.

* * * * *